US009217226B2

(12) United States Patent
Fung et al.

(10) Patent No.: US 9,217,226 B2
(45) Date of Patent: Dec. 22, 2015

(54) FIBROUS STRUCTURES

(75) Inventors: Joshua Thomas Fung, Cincinnati, OH (US); Angela Marie Leimbach, Hamilton, OH (US); John Allen Manifold, Sunman, IN (US); Steven Alexander Ramirez, Cincinnati, OH (US); Monica Ho-Kleinwaechter, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/570,357

(22) Filed: Aug. 9, 2012

(65) Prior Publication Data

US 2013/0040101 A1 Feb. 14, 2013

Related U.S. Application Data

(60) Provisional application No. 61/521,528, filed on Aug. 9, 2011.

(51) Int. Cl.
*B32B 23/04* (2006.01)
*D21H 27/00* (2006.01)

(52) U.S. Cl.
CPC ..... *D21H 27/005* (2013.01)

(58) Field of Classification Search
USPC ..... 428/532, 537.5; 162/112
See application file for complete search history.

(56) References Cited

U.S. PATENT DOCUMENTS

| | | | | |
|---|---|---|---|---|
| 8,334,049 | B2 * | 12/2012 | Manifold et al. | 428/326 |
| 8,334,050 | B2 * | 12/2012 | Manifold et al. | 428/326 |
| 8,383,235 | B2 * | 2/2013 | Manifold et al. | 428/326 |
| 8,449,976 | B2 * | 5/2013 | Manifold et al. | 428/326 |
| 2003/0118784 | A1 | 6/2003 | Hollmark | |
| 2009/0188637 | A1 | 7/2009 | Chan et al. | |
| 2011/0189442 | A1 * | 8/2011 | Manifold et al. | 428/174 |
| 2011/0189443 | A1 | 8/2011 | Manifold et al. | |
| 2011/0189451 | A1 * | 8/2011 | Manifold et al. | 428/219 |

FOREIGN PATENT DOCUMENTS

| | | | |
|---|---|---|---|
| WO | WO2011/014361 | * | 2/2011 |
| WO | WO 2011/014361 A1 | | 2/2011 |

OTHER PUBLICATIONS

All Office Actions in U.S. Appl. Nos. 13/570,346; 13/570,357.
U.S. Appl. No. 13/570,346, filed Aug. 9, 2012, Fung, et al.
International Search Report Mailed Oct. 12, 2012.

* cited by examiner

*Primary Examiner* — Leszek Kiliman
(74) *Attorney, Agent, or Firm* — C. Brant Cook

(57) ABSTRACT

Fibrous structures that exhibit a Geometric Mean Overhang Length (GM Overhang Length) of less than 3.65 cm as measured according to the Flexural Rigidity Test Method and/or a Cross-Machine Direction Overhang Length (CD Overhang Length) of less than 3.875 cm as measured according to the Flexural Rigidity Test Method described herein are provided.

20 Claims, 16 Drawing Sheets

FIBROUS STRUCTURES

CROSS REFERENCE TO RELATED APPLICATION(S)

This application claims the benefit of U.S. Provisional Application No. 61/521,528, filed Aug. 9, 2011.

FIELD OF THE INVENTION

The present invention relates to fibrous structures that exhibit a Geometric Mean Overhang Length (GM Overhang Length) of less than 3.65 cm as measured according to the Flexural Rigidity Test Method and/or a Cross-Machine Direction Overhang Length (CD Overhang Length) of less than 3.875 cm as measured according to the Flexural Rigidity Test Method described herein.

BACKGROUND OF THE INVENTION

Fibrous structures, particularly sanitary tissue products comprising fibrous structures, are known to exhibit different values for particular properties. These differences may translate into one fibrous structure being softer or stronger or more absorbent or more flexible or less flexible or exhibit greater stretch or exhibit less stretch, for example, as compared to another fibrous structure.

One property of fibrous structures that is desirable to consumers is the Overhang Length of the fibrous structure. It has been found that at least some consumers desire fibrous structures that exhibit a GM Overhang Length of less than 3.65 and/or a CD Overhang Length of less than 3.875 cm as measured according to the Flexural Rigidity Test Method.

SUMMARY OF THE INVENTION

The present invention fulfills the needs described above by providing a fibrous structure that exhibits a GM Overhang Length of less than 3.65 cm and/or a CD Overhang Length of less than 3.875 cm as measured according to the Flexural Rigidity Test Method.

In one example of the present invention, a wet textured fibrous structure that exhibits GM Overhang Length of less than 3.65 cm as measured according to the Flexural Rigidity Test Method described herein is provided.

In another example of the present invention, a fibrous structure that exhibits a GM Overhang Length of less than 3.65 cm as measured according to the Flexural Rigidity Test Method described herein and a Density of less than 0.073 g/cm$^3$ as measured according to the Density Test Method described herein is provided.

In another example of the present invention, a non-rolled fibrous structure that exhibits a CD Overhang Length of less than 3.65 cm as measured according to the Flexural Rigidity Test Method described herein is provided.

In still another example of the present invention, a fibrous structure that exhibits a CD Overhang Length of less than 3.65 cm as measured according to the Flexural Rigidity Test Method described herein and a CD Modulus of greater than 660 g/cm* % at 15 g/cm as measured according to the Modulus Test Method described herein is provided.

In still another example of the present invention, a fibrous structure that exhibits a CD Overhang Length of less than 3.65 cm as measured according to the Flexural Rigidity Test Method described herein and a Wet Burst of greater than 19.85 g and/or greater than 20 g as measured according to the Wet Burst Test Method described herein is provided.

In still another example of the present invention, a fibrous structure that exhibits a CD Overhang Length of less than 3.50 cm as measured according to the Flexural Rigidity Test Method described herein is provided.

In still another example of the present invention, a fibrous structure that exhibits a CD Overhang Length of less than 3.65 cm as measured according to the Flexural Rigidity Test Method described herein and a CD Elongation of less than 11% as measured according to the Elongation Test Method described herein is provided.

In still another example of the present invention, a fibrous structure that exhibits a CD Overhang Length of less than 3.65 cm as measured according to the Flexural Rigidity Test Method described herein and Dry Caliper of greater than 20 mils as measured according to the Caliper Test Method described herein is provided.

In still another example of the present invention, a non-rolled fibrous structure that exhibits a CD Overhang Length of less than 3.875 cm as measured according to the Flexural Rigidity Test Method described herein and a Dry Caliper of less than 19.4 mils as measured according to the Caliper Test Method described herein is provided.

In still yet another example of the present invention, a fibrous structure that exhibits a CD Overhang Length of less than 3.65 cm as measured according to the Flexural Rigidity Test Method described herein and a Basis Weight of less than 30.5 as measured according to the Basis Weight Test Method described herein is provided.

Accordingly, the present invention provides embossed fibrous structures that exhibit a GM Overhang Length of less than 3.65 cm as measured according to the Flexural Rigidity Test Method described herein and/or a CD Overhang Length of less than 3.875 cm as measured according to the Flexural Rigidity Test Method.

DETAILED DESCRIPTION OF THE INVENTION

Definitions

Figure 1:
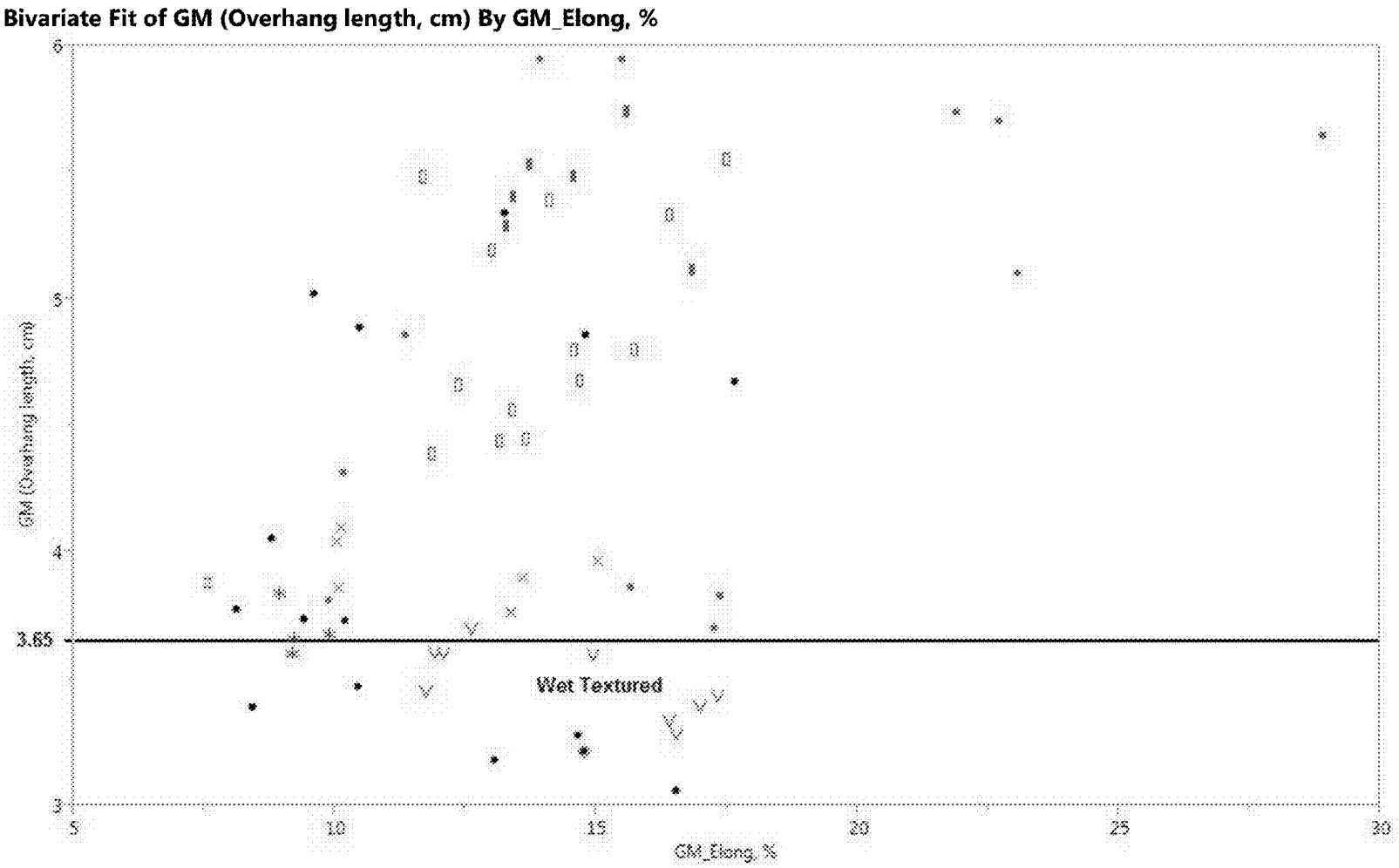
FIG. 1 is a plot of GM Overhang Length to GM Elongation for fibrous structures of the present invention and commercially available fibrous structures, both single-ply and multi-ply sanitary tissue products, illustrating the relatively low level of GM Overhang Length exhibited by the wet textured fibrous structures of the present invention.

"Fibrous structure" as used herein means a structure that comprises one or more filaments and/or fibers. In one example, a fibrous structure according to the present invention means an orderly arrangement of filaments and/or fibers within a structure in order to perform a function. Non-limiting examples of fibrous structures of the present invention include paper, fabrics (including woven, knitted, and non-woven), and absorbent pads (for example for diapers or feminine hygiene products).

Non-limiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous slurry is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

The fibrous structures of the present invention may be homogeneous or may be layered. If layered, the fibrous structures may comprise at least two and/or at least three and/or at least four and/or at least five layers.

The fibrous structures of the present invention may be co-formed fibrous structures.

"Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers, and filaments, such as polypropylene filaments.

"Solid additive" as used herein means a fiber and/or a particulate.

"Particulate" as used herein means a granular substance or powder.

"Fiber" and/or "Filament" as used herein means an elongate particulate having an apparent length greatly exceeding its apparent width, i.e. a length to diameter ratio of at least about 10. In one example, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Non-limiting examples of fibers include wood pulp fibers and synthetic staple fibers such as polyester fibers.

Filaments are typically considered continuous or substantially continuous in nature. Filaments are relatively longer than fibers. Non-limiting examples of filaments include melt-blown and/or spunbond filaments. Non-limiting examples of materials that can be spun into filaments include natural polymers, such as starch, starch derivatives, cellulose and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments and polycaprolactone filaments. The filaments may be monocomponent or multicomponent, such as bicomponent filaments.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

In addition to the various wood pulp fibers, other cellulosic fibers such as cotton linters, rayon, lyocell and bagasse can be used in this invention. Other sources of cellulose in the form of fibers or capable of being spun into fibers include grasses and grain sources.

"Sanitary tissue product" as used herein means a soft, low density (i.e. <about 0.15 g/cm3) web useful as a wiping implement for post-urinary and post-bowel movement cleaning (toilet tissue), for otorhinolaryngological discharges (facial tissue), and multi-functional absorbent and cleaning uses (absorbent towels). The sanitary tissue product may be convolutely wound upon itself about a core or without a core to form a sanitary tissue product roll.

In one example, the sanitary tissue product of the present invention comprises a fibrous structure according to the present invention.

The sanitary tissue products and/or fibrous structures of the present invention may exhibit a basis weight of greater than 15 g/m2 (9.2 lbs/3000 $ft^2$) to about 120 $g/m^2$ (73.8 lbs/3000 $ft^2$) and/or from about 15 $g/m^2$ (9.2 lbs/3000 $ft^2$) to about 110 $g/m^2$ (67.7 lbs/3000 $ft^2$) and/or from about 20 $g/m^2$ (12.3 lbs/3000 $ft^2$) to about 100 $g/m^2$ (61.5 lbs/3000 $ft^2$) and/or from about 30 (18.5 lbs/3000 $ft^2$) to 90 $g/m^2$ (55.4 lbs/3000 $ft^2$). In addition, the sanitary tissue products and/or fibrous structures of the present invention may exhibit a basis weight between about 40 $g/m^2$ (24.6 lbs/3000 $ft^2$) to about 120 $g/m^2$ (73.8 lbs/3000 $ft^2$) and/or from about 50 $g/m^2$ (30.8 lbs/3000 $ft^2$) to about 110 $g/m^2$ (67.7 lbs/3000 $ft^2$) and/or from about 55 $g/m^2$ (33.8 lbs/3000 $ft^2$) to about 105 $g/m^2$ (64.6 lbs/3000 $ft^2$) and/or from about 60 (36.9 lbs/3000 $ft^2$) to 100 $g/m^2$ (61.5 lbs/3000 $ft^2$).

The sanitary tissue products of the present invention may exhibit a total dry tensile strength of greater than about 59 g/cm (150 g/in) and/or from about 78 g/cm (200 Win) to about 394 g/cm (1000 Win) and/or from about 98 g/cm (250 g/in) to about 335 g/cm (850 g/in). In addition, the sanitary tissue product of the present invention may exhibit a total dry tensile strength of greater than about 196 g/cm (500 g/in) and/or from about 196 g/cm (500 g/in) to about 394 g/cm (1000 g/in) and/or from about 216 g/cm (550 g/in) to about 335 g/cm (850 g/in) and/or from about 236 g/cm (600 g/in) to about 315 g/cm (800 g/in). In one example, the sanitary tissue product exhibits a total dry tensile strength of less than about 394 g/cm (1000 g/in) and/or less than about 335 g/cm (850 g/in).

In another example, the sanitary tissue products of the present invention may exhibit a total dry tensile strength of greater than about 196 g/cm (500 g/in) and/or greater than about 236 g/cm (600 g/in) and/or greater than about 276 g/cm (700 g/in) and/or greater than about 315 g/cm (800 Win) and/or greater than about 354 g/cm (900 g/in) and/or greater than about 394 g/cm (1000 g/in) and/or from about 315 g/cm (800 g/in) to about 1968 g/cm (5000 g/in) and/or from about 354 g/cm (900 g/in) to about 1181 g/cm (3000 g/in) and/or from about 354 g/cm (900 g/in) to about 984 g/cm (2500 g/in) and/or from about 394 g/cm (1000 g/in) to about 787 g/cm (2000 g/in).

The sanitary tissue products of the present invention may exhibit an initial total wet tensile strength of less than about 78 g/cm (200 g/in) and/or less than about 59 g/cm (150 g/in) and/or less than about 39 g/cm (100 g/in) and/or less than about 29 g/cm (75 g/in).

The sanitary tissue products of the present invention may exhibit an initial total wet tensile strength of greater than about 118 g/cm (300 g/in) and/or greater than about 157 g/cm (400 g/in) and/or greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 118 g/cm (300 g/in) to about 1968 g/cm (5000 g/in) and/or from about 157 g/cm (400 g/in) to about 1181 g/cm (3000 g/in) and/or from about 196 g/cm (500 g/in) to about 984 g/cm (2500 g/in) and/or from about 196 g/cm (500 g/in) to about 787 g/cm (2000 g/in) and/or from about 196 g/cm (500 g/in) to about 591 g/cm (1500 g/in).

The sanitary tissue products of the present invention may exhibit a density (measured at 95 $g/in^2$) of less than about 0.60 $g/cm^3$ and/or less than about 0.30 $g/cm^3$ and/or less than about 0.20 $g/cm^3$ and/or less than about 0.10 $g/cm^3$ and/or less than about 0.07 $g/cm^3$ and/or less than about 0.05 $g/cm^3$ and/or from about 0.01 $g/cm^3$ to about 0.20 $g/cm^3$ and/or from about 0.02 $g/cm^3$ to about 0.10 $g/cm^3$.

The sanitary tissue products of the present invention may be in the form of sanitary tissue product rolls. Such sanitary tissue product rolls may comprise a plurality of connected, but perforated sheets of fibrous structure, that are separably dispensable from adjacent sheets.

The fibrous structures and/or sanitary tissue products of the present invention may comprises additives such as softening agents, temporary wet strength agents, permanent wet strength agents, bulk softening agents, lotions, silicones, wetting agents, latexes, especially surface-pattern-applied latexes, dry strength agents such as carboxymethylcellulose and starch, and other types of additives suitable for inclusion in and/or on sanitary tissue products.

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121.

"Basis Weight" as used herein is the weight per unit area of a sample reported in lbs/3000 $ft^2$ or $g/m^2$ (gsm) and is measured according to the Basis Weight Test Method described herein described herein.

"Caliper" as used herein means the macroscopic thickness of a fibrous structure. Caliper is measured according to the Caliper Test Method described herein described herein.

"Density" as used herein is calculated as the quotient of the Basis Weight of a fibrous structure expressed in gsm divided by the Caliper of the fibrous structure expressed in microns. The resulting Density of a fibrous structure is expressed as $g/cm^3$.

"Bulk" as used herein is calculated as the quotient of the Caliper (hereinafter defined), expressed in microns, divided by the basis weight, expressed in grams per square meter. The resulting Bulk is expressed as cubic centimeters per gram. For the products of this invention, Bulks can be greater than about 3 $cm^3/g$ and/or greater than about 6 $cm^3/g$ and/or greater than about 9 $cm^3/g$ and/or greater than about 10.5 $cm^3/g$ up to about 30 $cm^3/g$ and/or up to about 20 $cm^3/g$ . The products of this invention derive the Bulks referred to above from the basesheet, which is the sheet produced by the tissue machine without post treatments such as embossing. Nevertheless, the basesheets of this invention can be embossed to produce even greater bulk or aesthetics, if desired, or they can remain unembossed. In addition, the basesheets of this invention can be calendered to improve smoothness or decrease the Bulk if desired or necessary to meet existing product specifications.

"Wet Burst" as used herein is a measure of the ability of a fibrous structure and/or a sanitary tissue product incorporating a fibrous structure to absorb energy, when wet and subjected to deformation normal to the plane of the fibrous structure and/or fibrous structure product and is measured according to the Wet Burst Test Method described herein.

"Machine Direction" or "MD" as used herein means the direction parallel to the flow of the fibrous structure through the fibrous structure making machine and/or sanitary tissue product manufacturing equipment.

"Cross Machine Direction" or "CD" as used herein means the direction parallel to the width of the fibrous structure making machine and/or sanitary tissue product manufacturing equipment and perpendicular to the machine direction.

"Ply" as used herein means an individual, integral fibrous structure.

"Plies" as used herein means two or more individual, integral fibrous structures disposed in a substantially contiguous, face-to-face relationship with one another, forming a multi-ply fibrous structure and/or multi-ply sanitary tissue product. It is also contemplated that an individual, integral fibrous structure can effectively form a multi-ply fibrous structure, for example, by being folded on itself.

"Line element" as used herein means a discrete, portion of a fibrous structure being in the shape of a line, which may be of any suitable shape such as straight, bent, kinked, curled, curivilinear, serpentine, sinusoidal and mixtures thereof, wherein the line has a length of greater than about 1 mm and/or greater than 2 mm and/or greater than 3 mm and/or greater than 4.5 mm. In one example, a first line element is interrupted by a second line element different from the first line element. In another example, a first line element is interrupted by a second line element identical or substantially identical to the first line element.

Different line elements may exhibits different common intensive properties. For example, different line elements may exhibit different densities and/or basis weights. In one example, a fibrous structure of the present invention comprises a first group of first line elements and a second group of second line elements. The first group of first line elements may exhibit the same densities, which are lower than the densities of second line elements in a second group.

In one example, the line element is a straight or substantially straight line element. In another example, the line element is a curvilinear line element. Unless otherwise stated, the line elements of the present invention are present on a surface of a fibrous structure. The length and/or width and/or height of the line element and/or line element forming component within a molding member, which results in a line element within a fibrous structure, is measured by the Dimensions of Linear Element/Linear Element Forming Component Test Method described herein.

In one example, the line element and/or line element forming component is continuous or substantially continuous within a fibrous structure, for example in one case one or more 11 cm×11 cm sheets of fibrous structure.

The line elements may exhibit different widths along their lengths, between two or more different line elements and/or the line elements may exhibit different lengths. Different line elements my exhibit different widths and/or lengths.

"Average distance" as used herein with reference to the average distance between two line elements is the average of the distances measured between the centers of two immediately adjacent line elements measured along their respective lengths. Obviously, if one of the line elements extends further than the other, the measurements would stop at the ends of the shorter line element.

In one example, a plurality of line elements are present on the surface, such as a plurality of first line elements, then the average distance for the purpose of the ratio of average distances is the maximum average distance measured between immediately adjacent line elements within the plurality of line elements.

"Discrete" as it refers to a line element means that a line element has at least one immediate adjacent region of the fibrous structure that is different from the linear element.

"Unidirectional" as it refers to a linear element means that along the length of the linear element, the linear element does not exhibit a directional vector that contradicts the linear element's major directional vector.

"Uninterrupted" as it refers to a line element means that a line element does not have a region that is different from the line element cutting across the line element along its length. Undulations within a linear element such as those resulting from operations such as creping and/or foreshortening are not considered to result in regions that are different from the line element and thus do not interrupt the line element along its length.

"Water-resistant" as it refers to a line element means that a line element retains its structure and/or integrity after being saturated with water.

"Substantially machine direction oriented" as it refers to a line element means that the total length of the line element that is positioned at an angle of greater than 45° to the cross machine direction is greater than the total length of the line element that is positioned at an angle of 45° or less to the cross machine direction.

"Substantially cross machine direction oriented" as it refers to a line element means that the total length of the line element that is positioned at an angle of 45° or greater to the machine direction is greater than the total length of the line element that is positioned at an angle of less than 45° to the machine direction.

"Wet textured" as used herein means that a fibrous structure comprises texture (for example a three-dimensional topography) imparted to the fibrous structure and/or fibrous structure's surface during a fibrous structure making process. In one example, in a wet-laid fibrous structure making process, wet texture can be imparted to a fibrous structure upon fibers and/or filaments being collected on a collection device that has a three-dimensional (3D) surface which imparts a 3D surface to the fibrous structure being formed thereon and/or being transferred to a fabric and/or belt, such as a through-air-drying fabric and/or a patterned drying belt, comprising a 3D surface that imparts a 3D surface a fibrous structure being formed thereon. In one example, the collection device with a 3D surface comprises a patterned, such as a patterned formed by a polymer or resin being deposited onto a base substrate, such as a fabric, in a patterned configuration. The wet texture imparted to a wet-laid fibrous structure is formed in the fibrous structure prior to and/or during drying of the fibrous structure. Non-limiting examples of collection devices and/or fabric and/or belts suitable for imparting wet texture to a fibrous structure include those fabrics and/or belts used in fabric creping and/or belt creping processes, for example as disclosed in U.S. Pat. Nos. 7,820,008 and 7,789,995, coarse through-air-drying fabrics as used in uncreped through-air-drying processes, and photo-curable resin patterned through-air-drying belts, for example as disclosed in U.S. Pat. No.

4,637,859. This is different from non-wet texture that is imparted to a fibrous structure after the fibrous structure has been dried, for example after the moisture level of the fibrous structure is less than 15% and/or less than 10% and/or less than 5%. An example of non-wet texture are embossments imparted to a fibrous structure by embossing rolls during converting of the fibrous structure.

"Non-rolled" as used herein with respect to a fibrous structure and/or sanitary tissue product of the present invention means that the fibrous structure and/or sanitary tissue product is an individual sheet (for example not connected to adjacent sheets by perforation lines. However, two or more individual sheets may be interleaved with one another) that is not convolutely wound about a core or itself. For example, a non-rolled product comprises a facial tissue.

Fibrous Structure

The fibrous structures of the present invention may be a single-ply or multi-ply fibrous structure.

In one example of the present invention as shown in FIGS. 1-4, a fibrous structure, for example a wet textured fibrous structure, exhibits a GM Overhang Length of less than 3.65 cm as measured according to the Flexural Rigidity Test Method as described herein.

In another example of the present invention as shown in FIG. 1, a wet textured fibrous structure exhibits a GM Overhang Length of less than 3.65 cm and/or less than 3.60 cm and/or less than 3.55 cm and/or less than 3.50 cm and/or greater than 1 cm and/or greater than 2 cm and/or greater than 3 cm as measured according to the Flexural Rigidity Test Method described herein and a GM Elongation of greater than 5% and/or greater than 7% and/or greater than 8% and/or less than 50% and/or less than 30% and/or less than 15% and/or less than 12% as measured according to the Elongation Test Method described herein.

In another example of the present invention as shown in FIG. 1, a wet textured fibrous structure exhibits a GM Overhang Length of less than 3.65 cm and/or less than 3.60 cm and/or less than 3.55 cm and/or less than 3.50 cm and/or greater than 1 cm and/or greater than 2 cm and/or greater than 3 cm as measured according to the Flexural Rigidity Test Method described herein and a GM Elongation of greater than 5% and/or greater than 7% and/or greater than 8% and/or greater than 10% and/or less than 50% and/or less than 30% and/or less than 25% and/or less than 20% as measured according to the Elongation Test Method described herein.

Figure 2:
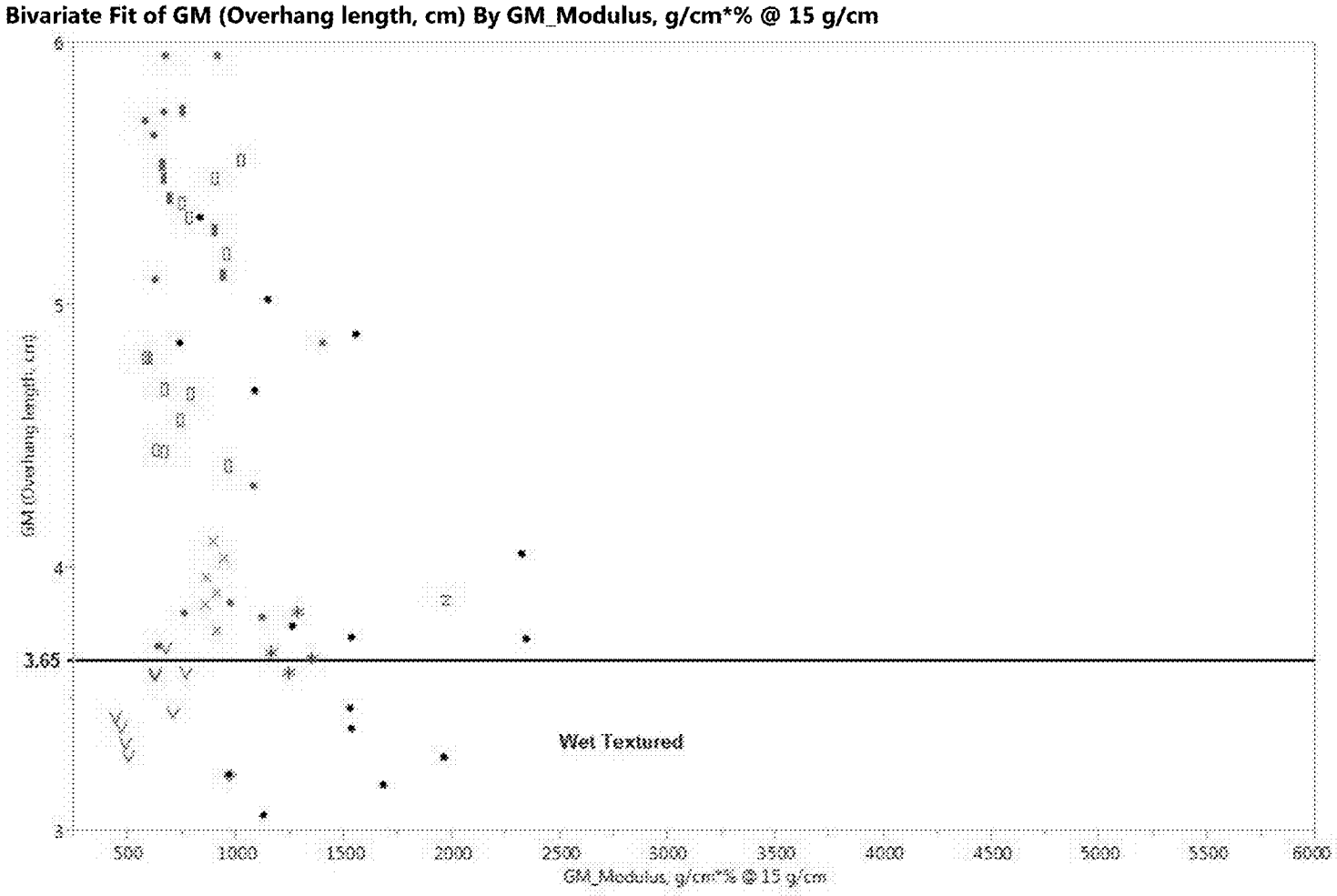
FIG. 2 is a plot of GM Overhang Length to GM Modulus for fibrous structures of the present invention and commercially available fibrous structures, both single-ply and multi-ply sanitary tissue products, illustrating the relatively low level of GM Overhang Length exhibited by the wet textured fibrous structures of the present invention.

In another example of the present invention as shown in FIG. 2, a wet textured fibrous structure exhibits a GM Overhang Length of less than 3.65 cm and/or less than 3.60 cm and/or less than 3.55 cm and/or less than 3.50 cm and/or greater than 1 cm and/or greater than 2 cm and/or greater than 3 cm as measured according to the Flexural Rigidity Test Method described herein and a GM Modulus of greater than 0 g/cm*% at 15g/cm and/or greater than 250 g/cm*% at 15g/cm and/or greater than 500 g/cm*% at 15g/cm and/or greater than 1000 g/cm*% at 15 g/cm and/or greater than 1250 g/cm*% at 15g/cm and/or less than 7000 g/cm*% at 15 g/cm and/or less than 5000 g/cm*% at 15g/cm and/or less than 4000 g/cm*% at I5g/cm and/or less than 3000 g/cm*% at 15g/cm and/or less than 2000 g/cm*% at 15g/cm and/or less than 1500 g/cm*% at 15g/cm as measured according to the Modulus Test Method described herein.

In another example of the present invention as shown in FIG. 2, a wet textured fibrous structure exhibits a GM Overhang Length of less than 3.65 cm and/or less than 3.60 cm and/or less than 3.55 cm and/or less than 3.50 cm and/or greater than 1 cm and/or greater than 2 cm and/or greater than 3 cm as measured according to the Flexural Rigidity Test Method described herein and a GM Modulus of greater than 0 g/cm*% at 15g/cm and/or greater than 250 g/cm*% at 15 g/cm and/or greater than 500 g/cm*% at 15g/cm and/or less than 7000 g/cm*% at 15 g/cm and/or less than 5000 g/cm*% at 15 g/cm and/or less than 4000 g/cm*% at 15 g/cm and/or less than 3000 g/cm*% at 15g/cm and/or less than 2000 g/cm*% at 15 g/cm and/or less than 1500 g/cm*% at 15 g/cm and/or less than 1000 g/cm*% at 15 g/cm as measured according to the Modulus Test Method described herein.

Figure 3:
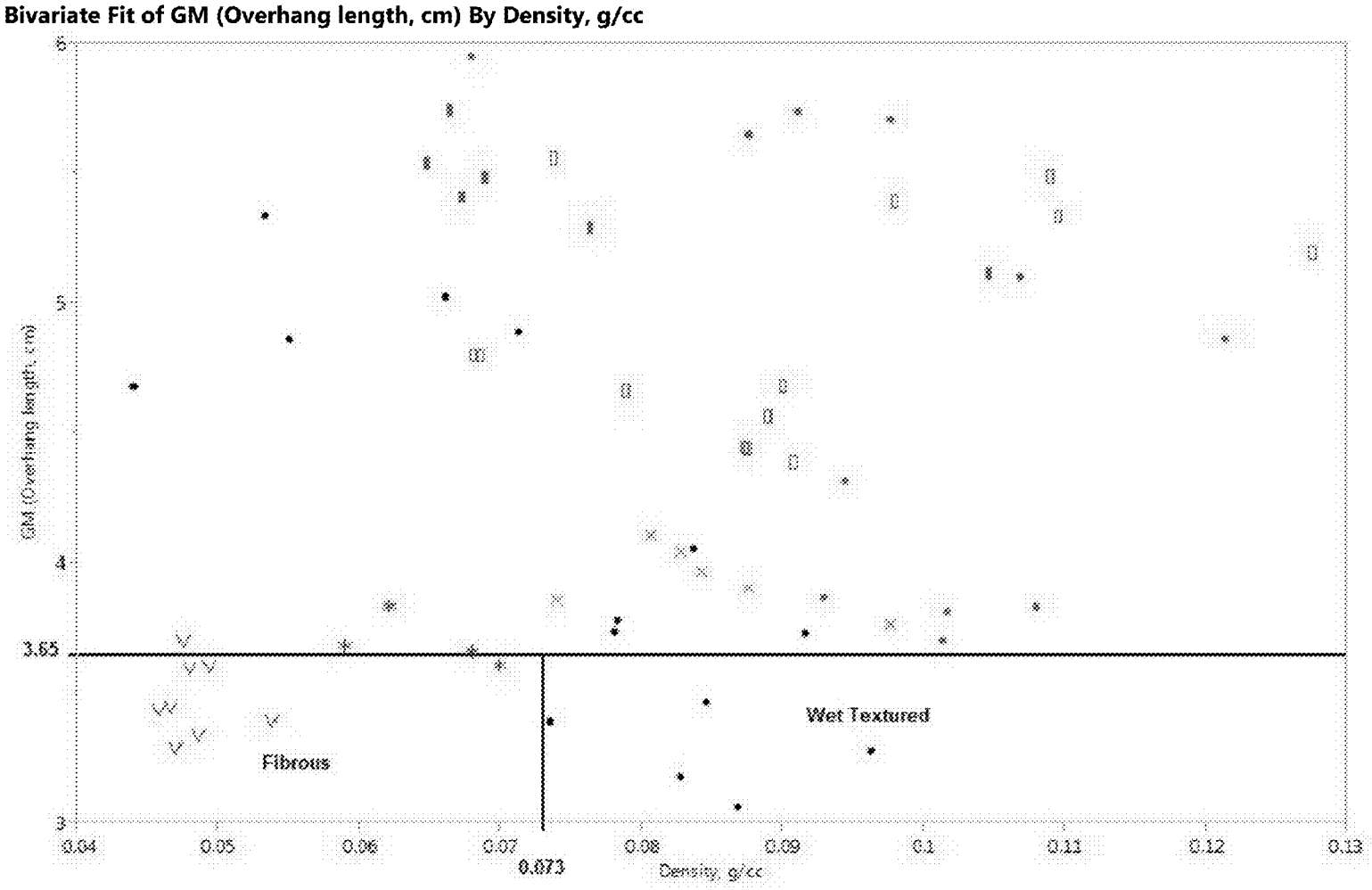
FIG. 3 is a plot of GM Overhang Length to Density for fibrous structures of the present invention and commercially available fibrous structures, both single-ply and multi-ply sanitary tissue products, illustrating the relatively low level of GM Overhang Length exhibited by the fibrous structures of the present invention.

In another example of the present invention as shown in FIG. 3, a fibrous structure exhibits a GM Overhang Length of less than 3.65 cm and/or less than 3.60 cm and/or less than 3.55 cm and/or less than 3.50 cm and/or greater than 1 cm and/or greater than 2 cm and/or greater than 3 cm as measured according to the Flexural Rigidity Test Method described herein and a Density of less than 0.073 g/cm$^3$ and/or less than 0.070 g/cm$^3$ and/or greater than 0 g/cm$^3$ and/or greater than 0.02 g/cm$^3$ and/or greater than 0.04 g/cm$^3$ and/or greater than 0.055 g/cm$^3$ as measured according to the Density Test Method described herein.

In another example of the present invention as shown in FIG. 3, a fibrous structure exhibits a GM Overhang Length of less than 3.65 cm and/or less than 3.60 cm and/or less than 3.55 cm and/or less than 3.50 cm and/or greater than 1 cm and/or greater than 2 cm and/or greater than 3 cm as measured according to the Flexural Rigidity Test Method described herein and a Density of less than 0.073 g/cm$^3$ and/or less than 0.070 g/cm$^3$ and/or less than 0.060 g/cm$^3$ greater than 0 g/cm$^3$ and/or greater than 0.02 g/cm$^3$ and/or greater than 0.04 g/cm$^3$ and/or greater than 0.045 g/cm$^3$ as measured according to the Density Test Method described herein.

Figure 4:
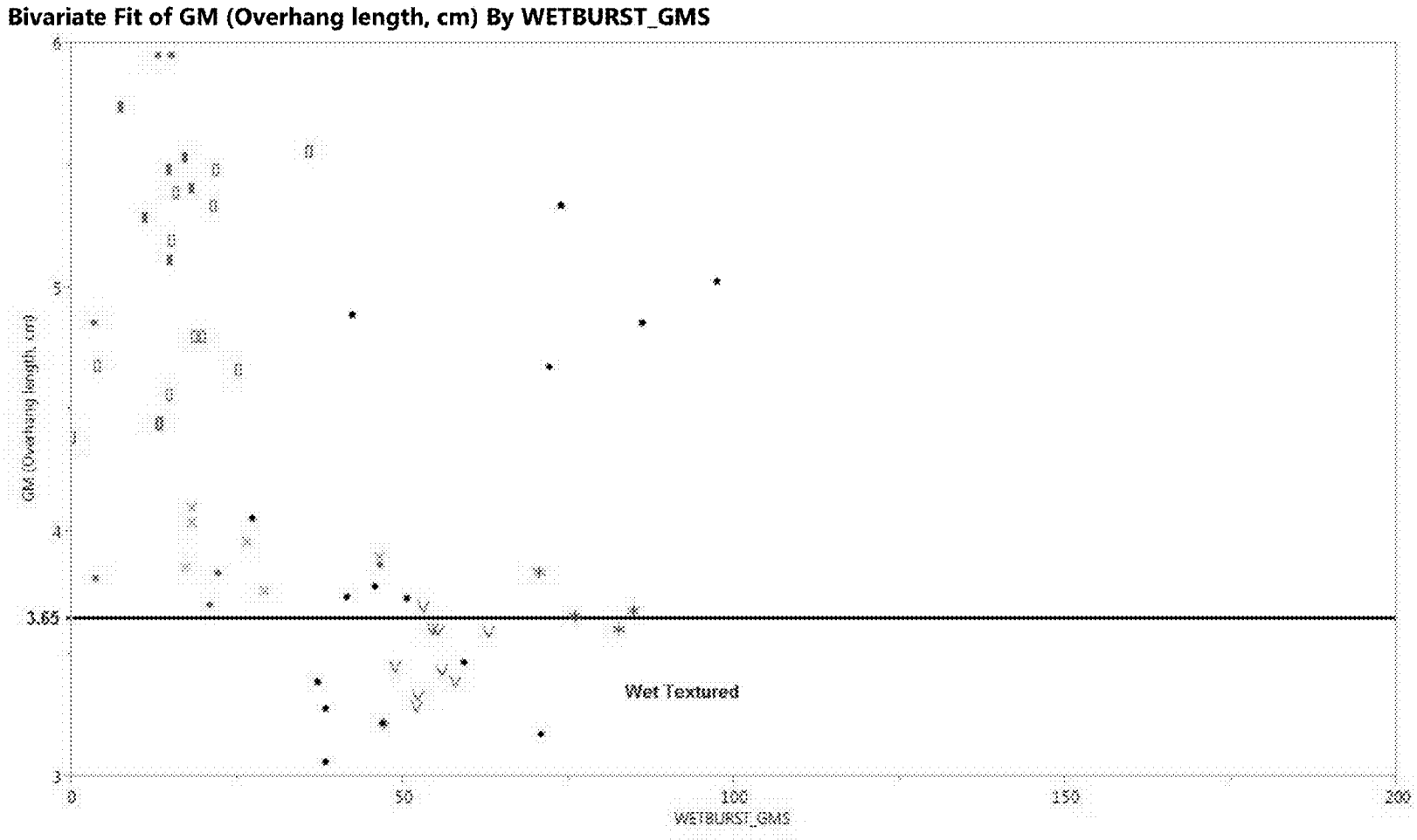
FIG. 4 is a plot of GM Overhang Length to Wet Burst for fibrous structures of the present invention and commercially available fibrous structures, both single-ply and multi-ply sanitary tissue products, illustrating the relatively low level of GM Overhang Length exhibited by the fibrous structures of the present invention.

In another example of the present invention as shown in FIG. 4, a wet textured fibrous structure exhibits a GM Overhang Length of less than 3.65 cm and/or less than 3.60 cm and/or less than 3.55 cm and/or less than 3.50 cm and/or greater than 1 cm and/or greater than 2 cm and/or greater than 3 cm as measured according to the Flexural Rigidity Test Method described herein and a Wet Burst of greater than 20.0 g and/or greater than 50 g and/or greater than 60 g and/or less than 1000 g and/or less than 500 g and/or less than 300 g and/or less than 150 g and/or less than 100 g and/or less than 90 g as measured according to the Wet Burst Test Method described herein.

In one example of the present invention as shown in FIGS. 5-9, a fibrous structure, for example a non-rolled fibrous structure, exhibits a GM Overhang Length of less than 3.875 cm and/or less than 3.65 cm and/or less than 3.60 cm and/or less than 3.55 cm and/or less than 3.50 cm as measured according to the Flexural Rigidity Test Method as described herein.

Figure 5:
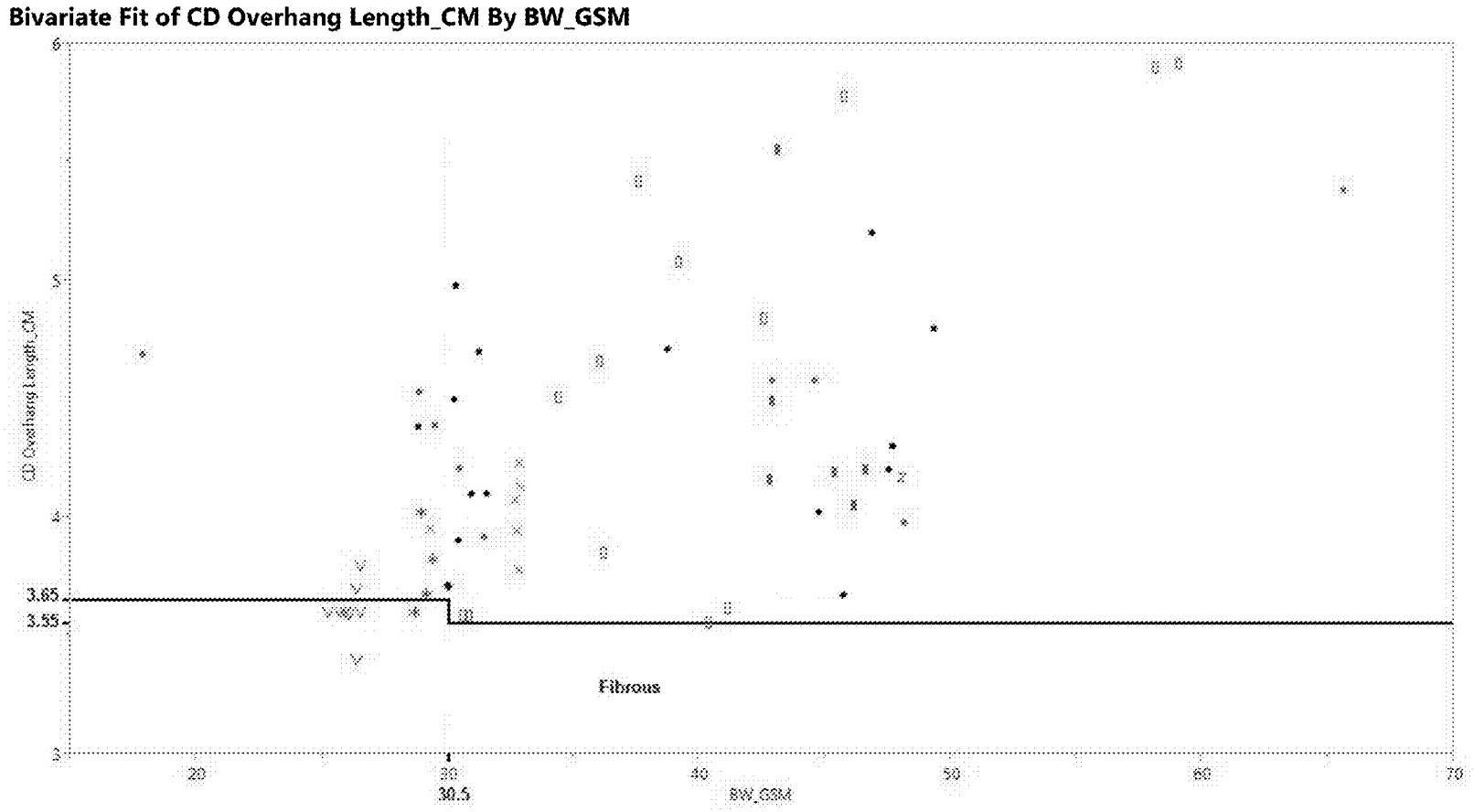
FIG. 5 is a plot of CD Overhang Length to Basis Weight for fibrous structures of the present invention and commercially available fibrous structures, both single-ply and multi-ply sanitary tissue products, illustrating the relatively low level of CD Overhang Length exhibited by the fibrous structures of the present invention.

In another example of the present invention as shown in FIG. 5, a fibrous structure exhibits a CD Overhang Length of less than 3.65 cm and/or less than 3.60 cm and/or less than 3.55 cm and/or less than 3.50 cm as measured according to the Flexural Rigidity Test Method described herein and a Basis Weight of less than 30.5 gsm and/or less than 30 gsm and/or less than 29.8 gsm and/or less than 29.0 gsm and/or greater than 5 gsm and/or greater than 10 gsm and/or greater than 15 gsm and/or greater than 20 gsm and/or greater than 25 gsm as measured according to the Basis Weight Test Method described herein.

Figure 6:
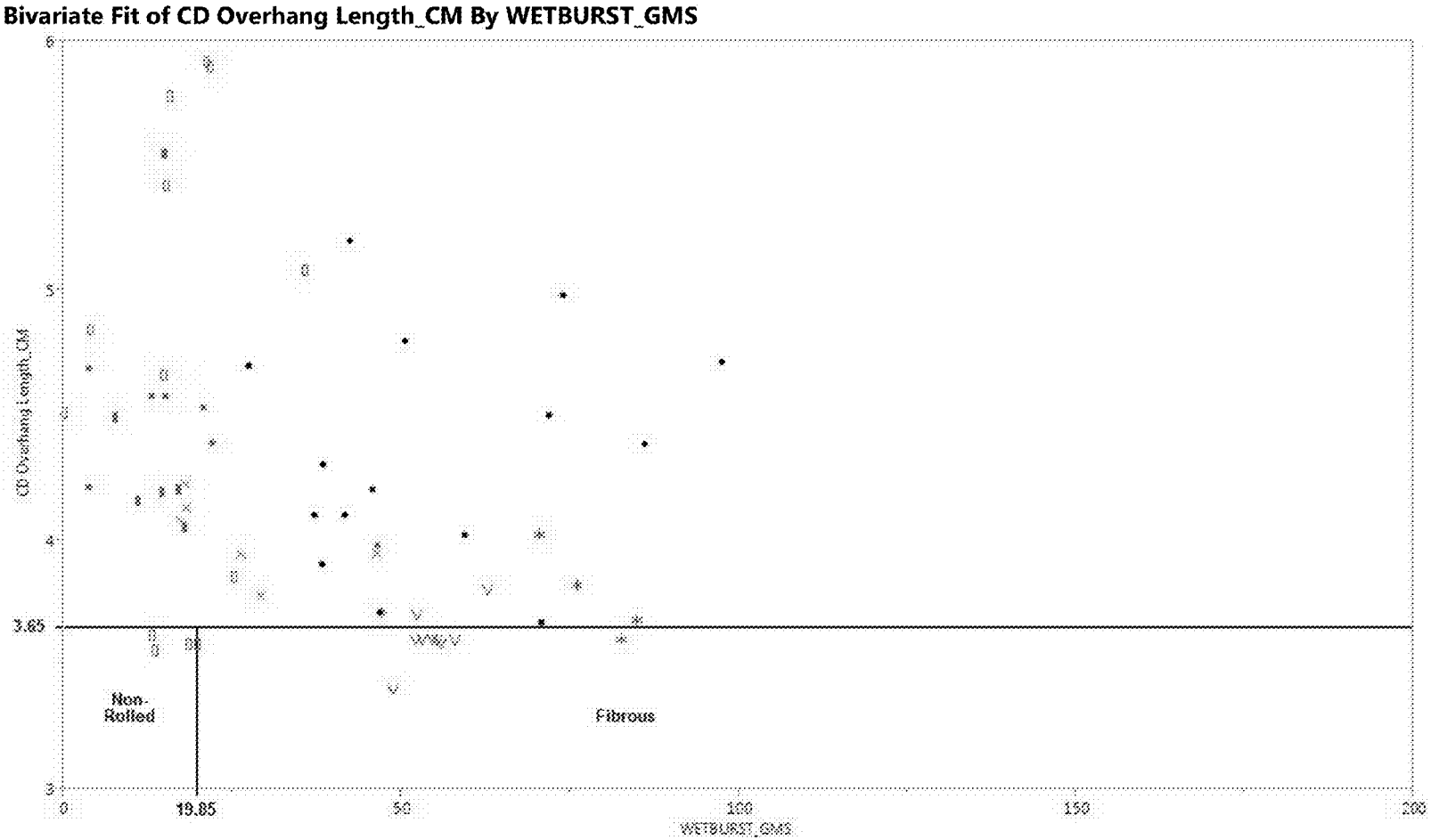
FIG. 6 is a plot of CD Overhang Length to Wet Burst for fibrous structures of the present invention and commercially available fibrous structures, both single-ply and multi-ply sanitary tissue products, illustrating the relatively low level of CD Overhang Length exhibited by the fibrous structures of the present invention.

In another example of the present invention as shown in FIG. 6, a fibrous structure exhibits a CD Overhang Length of less than 3.65 cm and/or less than 3.60 cm and/or less than 3.55 cm and/or less than 3.50 cm as measured according to the Flexural Rigidity Test Method described herein and a Wet Burst of greater than 20.0 g and/or greater than 50 g and/or greater than 70 g and/or greater than 75 g and/or greater than 80 g and/or to about 1000 g and/or to about 500 g and/or to about 400 g and/or to about 300 and/or to about 200 and/or to about 150 g as measured according to the Wet Burst Test Method described herein.

Figure 7:
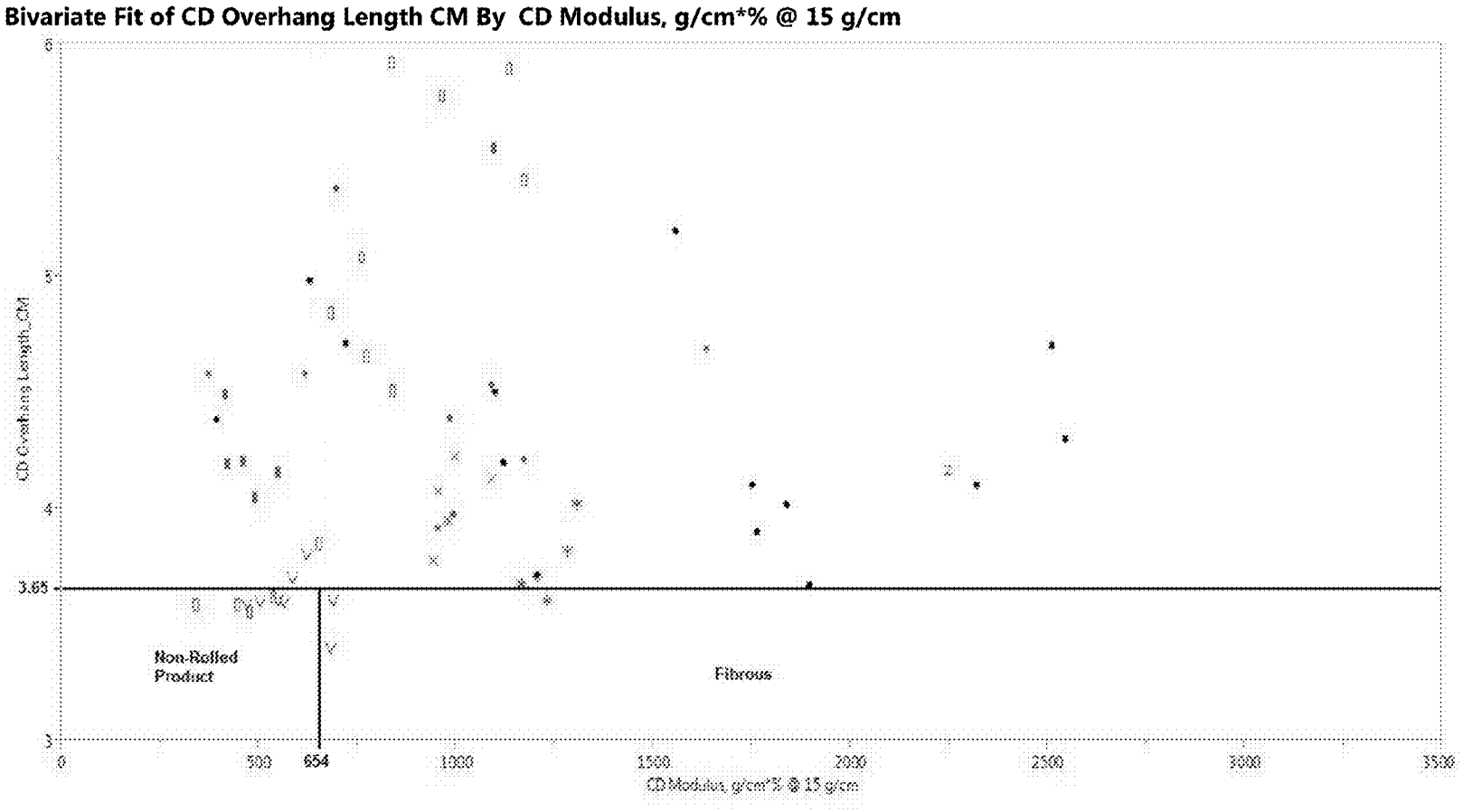
FIG. 7 is a plot of CD Overhang Length to CD Modulus for fibrous structures of the present invention and commercially available fibrous structures, both single-ply and multi-ply sanitary tissue products, illustrating the relatively low level of CD Overhang Length exhibited by the fibrous structures of the present invention.

In another example of the present invention as shown in FIG. 7, a fibrous structure, for example a non-rolled fibrous structure, exhibits a CD Overhang Length of less than 3.65 cm and/or less than 3.60 cm and/or less than 3.55 cm and/or less than 3.50 cm as measured according to the Flexural Rigidity Test Method described herein and a CD Modulus of greater than 0 g/cm*% at 15 g/cm and/or greater than 250 g/cm*% at 15 g/cm and/or greater than 500 g/cm*% at 15 g/cm and/or greater than 1000 g/cm*% at 15 g/cm and/or greater than 1250 g/cm*% at 15 g/cm and/or less than 7000 g/cm*% at 15 g/cm and/or less than 5000 g/cm*% at 15 g/cm and/or less than 4000 g/cm*% at 15 g/cm and/or less than 3000 g/cm*% at 15 g/cm and/or less than 2000 g/cm*% at 15 g/cm and/or less than 1500 g/cm*% at 15 g/cm as measured according to the Modulus Test Method described herein.

In another example of the present invention as shown in FIG. 7, a fibrous structure exhibits a CD Overhang Length of less than 3.65 cm and/or less than 3.60 cm and/or less than 3.55 cm and/or less than 3.50 cm as measured according to the Flexural Rigidity Test Method described herein and a CD Modulus of greater than 660 g/cm*% at 15 g/cm and/or greater than 700 g/cm*% at 15 g/cm and/or greater than 1000 as measured according to the Modulus Test Method described herein and/or greater than 1250 g/cm*% at 15 g/cm and/or less than 7000 g/cm*% at 15 g/cm and/or less than 5000 g/cm*% at 15 g/cm and/or less than 4000 g/cm*% at 15 g/cm and/or less than 3000 g/cm*% at 15 g/cm and/or less than 2000 g/cm*% at 15 g/cm and/or less than 1500 g/cm*% at 15 g/cm as measured according to the Modulus Test Method described herein.

Figure 8:
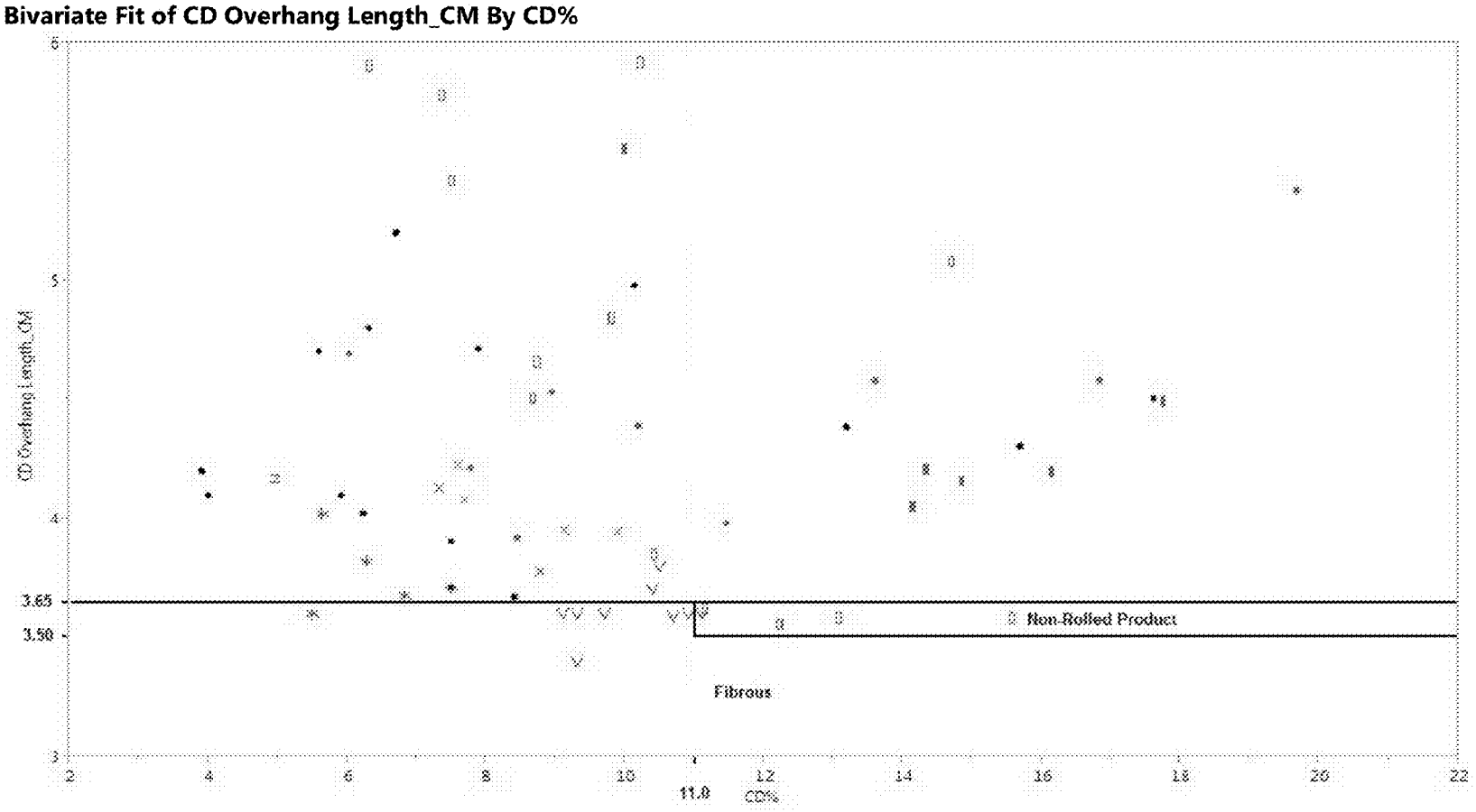
FIG. 8 is a plot of CD Overhang Length to CD Elongation for fibrous structures of the present invention and commercially available fibrous structures, both single-ply and multi-ply sanitary tissue products, illustrating the relatively low level of CD Overhang Length exhibited by the fibrous structures of the present invention.

In another example of the present invention as shown in FIG. 8, a fibrous structure exhibits a CD Overhang Length of less than 3.65 cm and/or less than 3.60 cm and/or less than 3.55 cm and/or less than 3.50 cm as measured according to the Flexural Rigidity Test Method described herein and a CD Elongation of greater than 0% and/or greater than 2% and/or greater than 3% and/or less than 50% and/or less than 30% and/or less than 15% and/or less than 10% and/or less than 7% and/or less than 5% as measured according to the Elongation Test Method described herein.

In another example of the present invention as shown in FIG. 8, a fibrous structure, for example a non-rolled fibrous structure, exhibits a CD Overhang Length of less than 3.65 cm and/or less than 3.60 cm and/or less than 3.55 cm and/or less than 3.50 cm as measured according to the Flexural Rigidity Test Method described herein and a CD Elongation of greater than 11% as measured according to the Elongation Test Method described herein.

Figure 9:
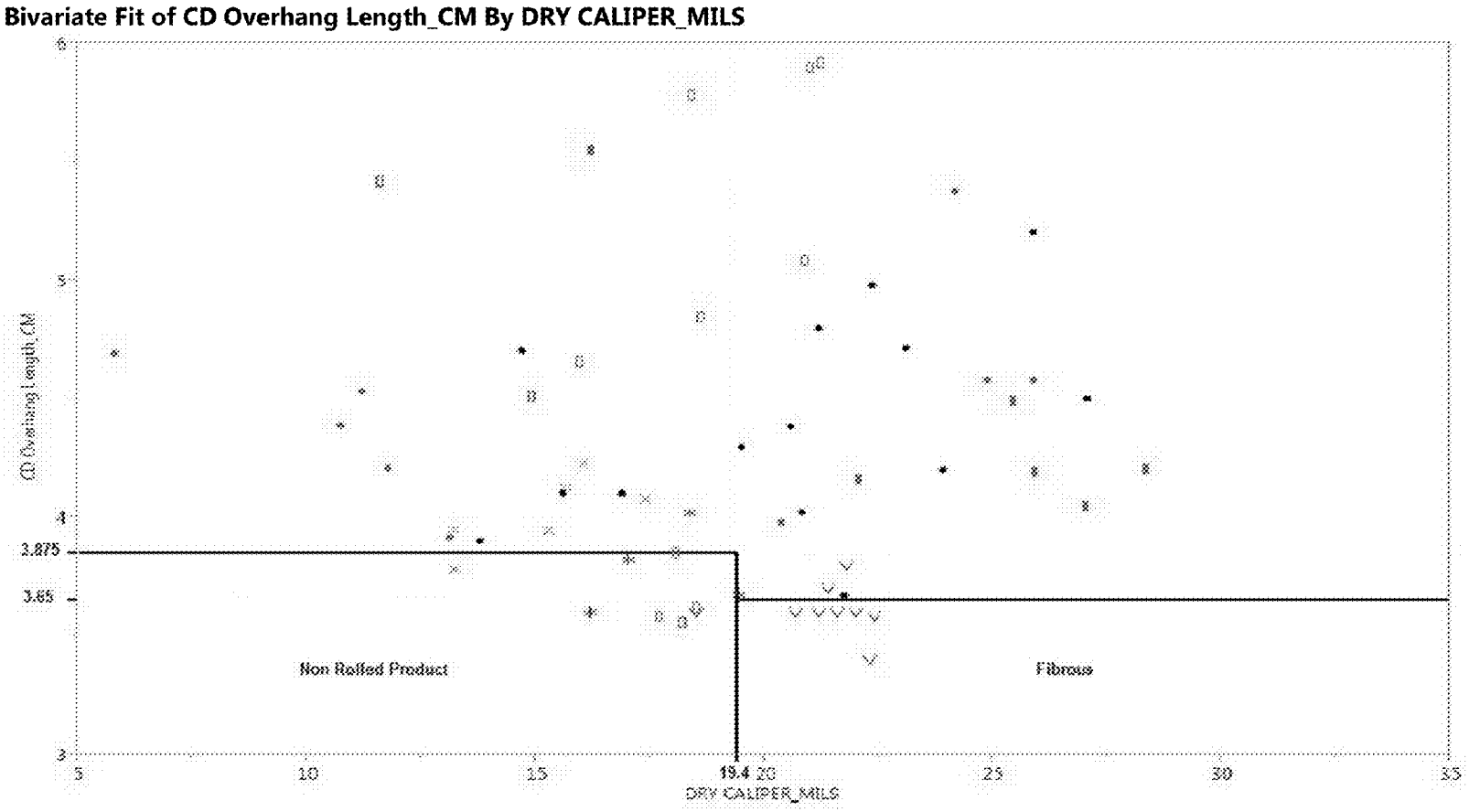
FIG. 9 is a plot of CD Overhang Length to Dry Caliper for fibrous structures of the present invention and commercially available fibrous structures, both single-ply and multi-ply sanitary tissue products, illustrating the relatively low level of CD Overhang Length exhibited by the fibrous structures of the present invention.

In another example of the present invention as shown in FIG. 9, a non-rolled fibrous structure exhibits a CD Overhang Length of less than 3.875 cm and/or less than 3.65 cm and/or less than 3.60 cm and/or less than 3.55 cm and/or less than 3.50 cm as measured according to the Flexural Rigidity Test Method described herein and a Dry Caliper of less than 19.4 mils and/or less than 19 mils and/or less than 18 mils and/or less than 17 mils and/or greater than 0 mils and/or greater than 10 mils and/or greater than 15 mils as measured according to the Caliper Test Method described herein.

In another example of the present invention as shown in FIG. 9, a fibrous structure exhibits a CD Overhang Length of less than 3.65 cm and/or less than 3.60 cm and/or less than 3.55 cm and/or less than 3.50 cm as measured according to the Flexural Rigidity Test Method described herein and a Dry Caliper of less than 50 mils and/or less than 40 mils and/or less than 30 mils and/or greater than 19.4 mils and/or greater than 20 mils as measured according to the Caliper Test Method described herein.

Tables 1-4 below shows the physical property values of some fibrous structures in accordance with the present invention and commercially available fibrous structures.

TABLE 1

| Fibrous Structure | # of Plies | Wet Textured | Non-rolled | GM Overhang Length cm | CD Overhang Length cm | GM Modulus g/cm * % @ 15 g/cm | CD Modulus g/cm * % @ 15 g/cm |
|---|---|---|---|---|---|---|---|
| Inv A | 2-ply | Y | Y | 3.66 | 3.82 | 1349.3 | 1281 |
| Inv B | 2-ply | Y | Y | 3.60 | 3.60 | 1238.5 | 1231 |
| Inv C | 2-ply | Y | Y | 3.84 | 4.02 | 1276.7 | 1306 |
| Inv D | 1-ply | Y | Y | 3.39 | 3.60 | 460.9 | 501 |
| Inv E | 1-ply | Y | Y | 3.44 | 3.59 | 438.4 | 470 |
| Inv F | 1-ply | Y | Y | 3.70 | 3.60 | 668.9 | 549 |
| Inv G | 1-ply | Y | Y | 3.60 | 3.60 | 627.3 | 502 |
| Inv H | 1-ply | Y | Y | 3.59 | 3.80 | 617.0 | 620 |
| Inv I | 1-ply | Y | Y | 3.60 | 3.60 | 765.2 | 688 |
| Inv J | 1-ply | Y | Y | 3.45 | 3.40 | 704.6 | 682 |
| Inv K | 1-ply | Y | Y | 3.29 | 3.60 | 498.8 | 563 |
| Inv L | 1-ply | Y | Y | 3.33 | 3.70 | 486.6 | 586 |
| COTTONELLE ® ALOE & E | 1-ply | Y | N | 4.7 | 3.9 | 785 | 651 |
| Cottonelle ® Ultra | 2-ply | Y | N | 5.5 | 4.2 | 661 | 460 |
| Cottonelle ® with Ripples | 1-ply | Y | N | 4.4 | 3.6 | 627 | 475 |
| Angel Soft ® | 2-ply | N | N | 4.7 | 4.8 | 667 | 682 |
| QN Soft&Strong | 2-ply | N | N | 5.1 | 5.6 | 935 | 1097 |
| Quilted Northern ® Ultra | 3-ply | N | N | 5.3 | 5.9 | 779 | 836 |
| Scott 1000 | 1-ply | N | N | 3.8 | 4.2 | 1118 | 1173 |
| Charmin ® Basic | 1-ply | Y | N | 3.7 | 4.5 | 640 | 1092 |
| Charmin ® Basic | 1-ply | Y | N | 4.0 | 3.9 | 861 | 982 |
| CHARMIN Ultra (Lexus 0.5) | 2-ply | Y | N | 3.9 | 4.0 | 972 | 994 |

TABLE 1-continued

| Fibrous Structure | # of Plies | Wet Textured | Non-rolled | GM Overhang Length cm | CD Overhang Length cm | GM Modulus g/cm * % @ 15 g/cm | CD Modulus g/cm * % @ 15 g/cm |
|---|---|---|---|---|---|---|---|
| Charmin ® Ultra Strong | 2-ply | Y | N | 7.4 | 6.6 | 1106 | 874 |
| Charmin ® Ultra Soft | 2-ply | Y | N | 6.9 | 6.8 | 880 | 922 |
| Bounty ® Basic | 1-ply | Y | N | 7.1 | 7.4 | 1402 | 1569 |
| Bounty ® | 2-ply | Y | N | 11.0 | 10.9 | 2597 | 2502 |
| Brawny ® | 2-ply | Y | N | 10.1 | 9.8 | 2099 | 3410 |
| Kleenex Viva ® | 1-ply | Y | N | 5.6 | 6.6 | 619 | 1029 |
| Kleenex ® Basic | not available | N | Y | NA | NA | 1215 | 1424 |
| Kleenex ® Ultra | not available | N | Y | 3.5 | 4.0 | 1528 | 1839 |
| Kleenex ® Lotion | not available | N | Y | 3.2 | 3.7 | 1680 | 1896 |
| Scotties ® US Basic | not available | N | Y | 3.4 | 4.1 | 1534 | 2321 |
| Scotties ® US Ultra | not available | N | Y | 3.7 | 4.8 | 2345 | 3530 |
| Scotties ® CA Supreme | not available | N | Y | 4.9 | 5.2 | 1550 | 1559 |
| Green Forest Environmental ® | not available | N | Y | 3.1 | 3.9 | 1128 | 1764 |

TABLE 2

| Fibrous Structure | # of Plies | Wet Textured | Non-rolled | Density $g/cm^3$ | Wet Burst g | Basis Weight gsm |
|---|---|---|---|---|---|---|
| Inv A | 2-ply | Y | Y | 0.068 | 76.0 | 29.4 |
| Inv B | 2-ply | Y | Y | 0.070 | 82.5 | 28.7 |
| Inv C | 2-ply | Y | Y | 0.062 | 70.5 | 28.9 |
| Inv D | 1-ply | Y | Y | 0.054 | 57.8 | 25.2 |
| Inv E | 1-ply | Y | Y | 0.046 | 55.8 | 26.0 |
| Inv F | 1-ply | Y | Y | 0.047 | 53.0 | 26.5 |
| Inv G | 1-ply | Y | Y | 0.049 | 55.3 | 25.9 |
| Inv H | 1-ply | Y | Y | 0.048 | 62.8 | 26.5 |
| Inv I | 1-ply | Y | Y | 0.049 | 54.5 | 26.5 |
| Inv J | 1-ply | Y | Y | 0.047 | 48.8 | 26.4 |
| Inv K | 1-ply | Y | Y | 0.047 | 52.0 | 25.7 |
| Inv L | 1-ply | Y | Y | 0.049 | 52.3 | 26.4 |
| COTTONELLE ® ALOE & E | 1-ply | Y | N | 0.079 | 25.2 | 36.2 |
| Cottonelle ® Ultra | 2-ply | Y | N | 0.065 | 17.0 | 46.6 |
| Cottonelle ® with Ripples | 1-ply | Y | N | 0.087 | 13.3 | 40.4 |
| Angel Soft ® | 2-ply | N | N | 0.090 | 3.8 | 42.5 |
| QN Soft&Strong | 2-ply | N | N | 0.105 | 14.8 | 43.1 |
| Quilted Northern ® Ultra | 3-ply | N | N | 0.109 | 21.2 | 59.0 |
| Scott 1000 | 1-ply | N | N | 0.102 | 3.7 | 30.5 |
| Charmin ® Basic | 1-ply | Y | N | 0.101 | 20.8 | 28.9 |
| Charmin ® Basic | 1-ply | Y | N | 0.084 | 26.3 | 32.7 |
| CHARMIN Ultra (Lexus 0.5) | 2-ply | Y | N | 0.093 | 46.6 | 48.2 |
| Charmin ® Ultra Strong | 2-ply | Y | N | 0.074 | NA | 39.4 |
| Charmin ® Ultra Soft | 2-ply | Y | N | 0.091 | NA | 49.7 |
| Bounty ® Basic | 1-ply | Y | N | 0.055 | 254.2 | 39.1 |
| Bounty ® | 2-ply | Y | N | 0.065 | 336.4 | 44.1 |
| Brawny ® | 2-ply | Y | N | 0.066 | 239.3 | 54.7 |
| Kleenex Viva ® | 1-ply | Y | N | 0.088 | 290.9 | 61.6 |
| Kleenex ® Basic | not available | N | Y | 0.074 | 55.5 | 29.6 |
| Kleenex ® Ultra | not available | N | Y | 0.085 | 59.3 | 44.8 |
| Kleenex ® Lotion | not available | N | Y | 0.083 | 70.9 | 45.7 |
| Scotties ® US Basic | not available | N | Y | 0.074 | 37.2 | 31.6 |
| Scotties ® US Ultra | not available | N | Y | 0.092 | 50.6 | 49.3 |
| Scotties ® CA Supreme | not available | N | Y | 0.071 | 42.4 | 46.9 |
| Green Forest Environmental ® | not available | N | Y | 0.087 | 38.3 | 30.4 |

TABLE 3

| Fibrous Structure | # of Plies | Wet Textured | Non-rolled | GM Elongation % | CD Elongation % |
|---|---|---|---|---|---|
| Inv A | 2-ply | Y | Y | 9.2 | 6 |
| Inv B | 2-ply | Y | Y | 9.2 | 6 |
| Inv C | 2-ply | Y | Y | 8.9 | 6 |
| Inv D | 1-ply | Y | Y | 17.0 | 11 |
| Inv E | 1-ply | Y | Y | 17.3 | 11 |
| Inv F | 1-ply | Y | Y | 12.6 | 10 |
| Inv G | 1-ply | Y | Y | 12.1 | 9 |
| Inv H | 1-ply | Y | Y | 14.9 | 11 |
| Inv I | 1-ply | Y | Y | 11.9 | 9 |
| Inv J | 1-ply | Y | Y | 11.7 | 9 |
| Inv K | 1-ply | Y | Y | 16.5 | 11 |
| Inv L | 1-ply | Y | Y | 16.4 | 10 |
| COTTONELLE ® ALOE & E | 1-ply | Y | N | 12.4 | 10.4 |
| Cottonelle ® Ultra | 2-ply | Y | N | 13.7 | 14.3 |
| Cottonelle ® with Ripples | 1-ply | Y | N | 13.6 | 12.2 |
| Angel Soft ® | 2-ply | N | N | 14.7 | 9.8 |
| QN Soft&Strong | 2-ply | N | N | 16.9 | 10.0 |
| Quilted Northern ® Ultra | 3-ply | N | N | 16.4 | 10.2 |
| Scott 1000 | 1-ply | N | N | 9.9 | 7.8 |
| Charmin ® Basic | 1-ply | Y | N | 17.3 | 8.9 |
| Charmin ® Basic | 1-ply | Y | N | 15.0 | 9.9 |
| CHARMIN Ultra (Lexus 0.5) | 2-ply | Y | N | 15.7 | 11.5 |
| Charmin ® Ultra Strong | 2-ply | Y | N | 15.7 | 12.5 |
| Charmin ® Ultra Soft | 2-ply | Y | N | 17.5 | 11.3 |
| Bounty ® Basic | 1-ply | Y | N | 11.7 | 9.8 |
| Bounty ® | 2-ply | Y | N | 11.8 | 10.6 |
| Brawny ® | 2-ply | Y | N | 12.5 | 7.9 |
| Kleenex Viva ® | 1-ply | Y | N | 28.9 | 19.8 |
| Kleenex ® Basic | not available | N | Y | 11.9 | 6.9 |
| Kleenex ® Ultra | not available | N | Y | 10.4 | 6.2 |
| Kleenex ® Lotion | not available | N | Y | 13.1 | 8.4 |
| Scotties ® US Basic | not available | N | Y | 8.4 | 4.0 |
| Scotties ® US Ultra | not available | N | Y | 10.2 | 6.3 |
| Scotties ® CA Supreme | not available | N | Y | 10.5 | 6.7 |
| Green Forest Environmental ® | not available | N | Y | 16.5 | 7.5 |

TABLE 4

| Fibrous Structure | # of Plies | Wet Textured | Non-rolled | CD TEA g * in/in$^2$ | Caliper mils | Dry CD Tensile Strength g/in |
|---|---|---|---|---|---|---|
| Inv A | 2-ply | Y | Y | 6.1 | 17.0 | 170 |
| Inv B | 2-ply | Y | Y | 5.7 | 16.2 | 159 |
| Inv C | 2-ply | Y | Y | 5.7 | 18.4 | 159 |
| Inv D | 1-ply | Y | Y | NA | 18.5 | 194 |
| Inv E | 1-ply | Y | Y | NA | 22.4 | 175 |
| Inv F | 1-ply | Y | Y | NA | 22.0 | 173 |
| Inv G | 1-ply | Y | Y | NA | 20.7 | 165 |
| Inv H | 1-ply | Y | Y | NA | 21.8 | 195 |
| Inv I | 1-ply | Y | Y | NA | 21.2 | 183 |
| Inv J | 1-ply | Y | Y | NA | 22.3 | 186 |
| Inv K | 1-ply | Y | Y | NA | 21.6 | 191 |
| Inv L | 1-ply | Y | Y | NA | 21.4 | 185 |
| COTTONELLE ® ALOE & E | 1-ply | Y | N | 8.2 | 18.1 | 157 |
| Cottonelle ® Ultra | 2-ply | Y | N | 11.8 | 28.3 | 175 |
| Cottonelle ® with Ripples | 1-ply | Y | N | 8.3 | 18.2 | 146 |
| Angel Soft ® | 2-ply | N | N | 7.5 | 18.6 | 130 |
| QN Soft&Strong | 2-ply | N | N | 10.0 | 16.2 | 155 |
| Quilted Northern ® Ultra | 3-ply | N | N | 10.0 | 21.2 | 144 |
| Scott 1000 | 1-ply | N | N | 8.2 | 11.8 | 188 |
| Charmin ® Basic | 1-ply | Y | N | 10.8 | 11.2 | 216 |

TABLE 4-continued

| Fibrous Structure | # of Plies | Wet Textured | Non-rolled | CD TEA g * in/in$^2$ | Caliper mils | Dry CD Tensile Strength g/in |
|---|---|---|---|---|---|---|
| Charmin ® Basic | 1-ply | Y | N | 13.2 | 15.3 | 257 |
| CHARMIN Ultra (Lexus 0.5) | 2-ply | Y | N | 14.1 | 20.4 | 195 |
| Charmin ® Ultra Strong | 2-ply | Y | N | 18.6 | 20.9 | 292 |
| Charmin ® Ultra Soft | 2-ply | Y | N | 12.0 | 21.6 | 202 |
| Bounty ® Basic | 1-ply | Y | N | 28.5 | 28.2 | 583 |
| Bounty ® | 2-ply | Y | N | 39.4 | 26.8 | 711 |
| Brawny ® | 2-ply | Y | N | 31.5 | 32.4 | 711 |
| Kleenex Viva ® | 1-ply | Y | N | 45.2 | 27.7 | 357 |
| Kleenex ® Basic | not available | N | Y | 6.5 | 15.8 | 157 |
| Kleenex ® Ultra | not available | N | Y | 5.2 | 20.8 | 190 |
| Kleenex ® Lotion | not available | N | Y | 5.9 | 21.8 | 230 |
| Scotties ® US Basic | not available | N | Y | 3.7 | 16.9 | 171 |
| Scotties ® US Ultra | not available | N | Y | 3.7 | 21.2 | 261 |
| Scotties ® CA Supreme | not available | N | Y | 5.7 | 25.9 | 193 |
| Green Forest Environmental ® | not available | N | Y | 6.4 | 13.8 | 182 |

In even yet another example of the present invention, a fibrous structure comprises cellulosic pulp fibers. However, other naturally-occurring and/or non-naturally occurring fibers and/or filaments may be present in the fibrous structures of the present invention.

In one example of the present invention, a fibrous structure comprises a throughdried fibrous structure. The fibrous structure may be creped or uncreped. In one example, the fibrous structure is a wet-laid fibrous structure.

In another example of the present invention, a fibrous structure may comprise one or more embossments.

The fibrous structure may be incorporated into a single- or multi-ply sanitary tissue product. The sanitary tissue product may be in roll form where it is convolutedly wrapped about itself with or without the employment of a core. In one example, the sanitary tissue product may be in individual sheet form, such as a stack of discrete sheets, such as in a stack of individual facial tissue.

Figure 10A:
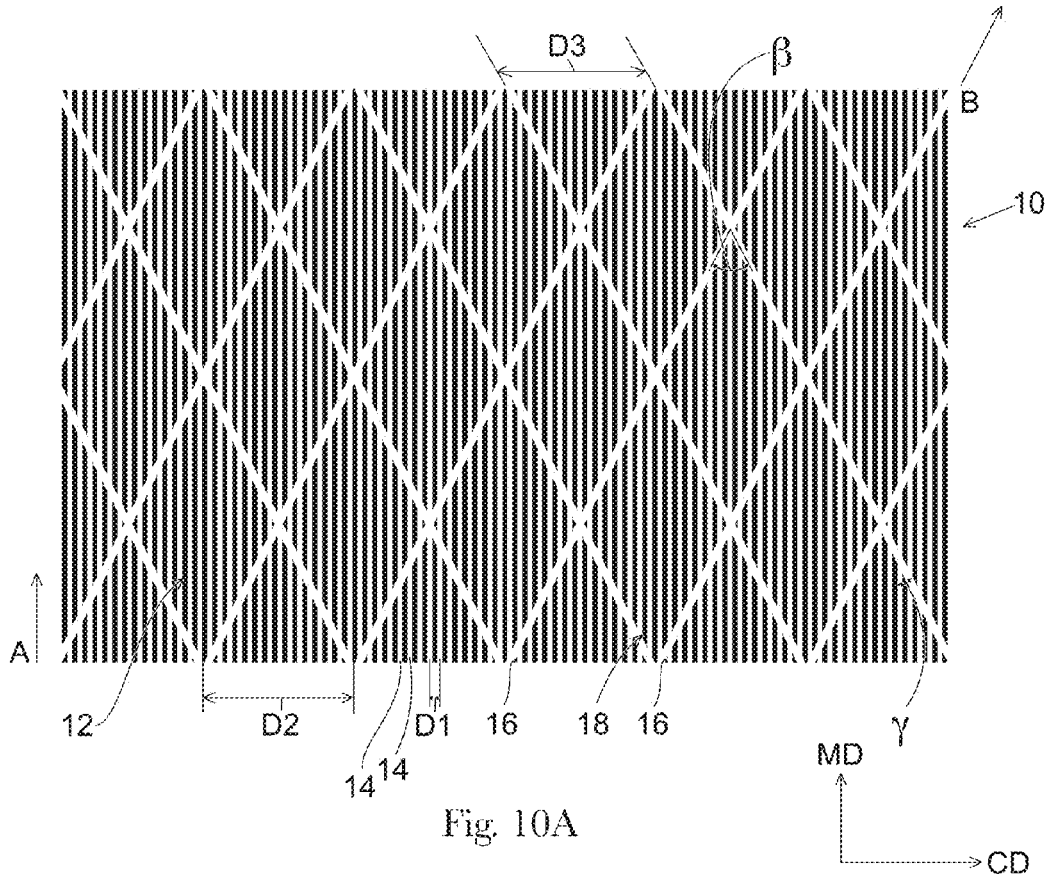
FIG. 10A is a schematic representation of an example of fibrous structure according to the present invention.
Figure 10B:
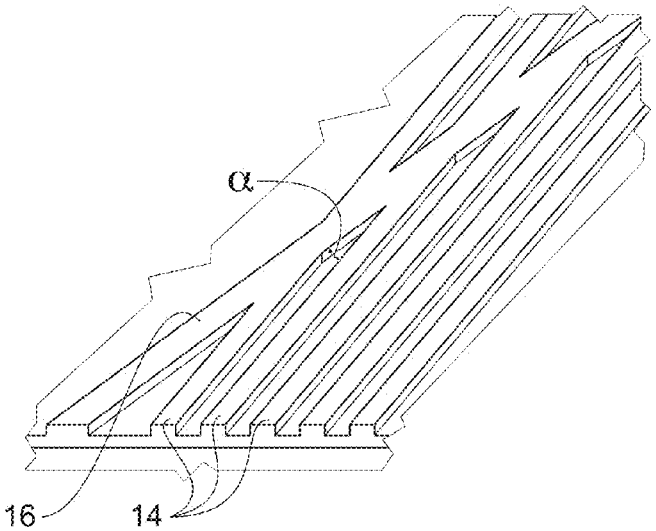
FIG. 10B is a exploded view of a portion of FIG. 10A.

As shown in FIGS. 10A and 10B, an example of a fibrous structure 10 of the present invention comprises a surface 12 comprising at least two first line elements 14 extending in a first direction A and at least two second line elements 16 extending in a second direction B wherein the ratio of the average distance $D_2$ between the two second line elements 16 and the average distance $D_1$ between the two first line elements 14 is greater than 1 and/or greater than 1.2 and/or greater than 1.5 and/or greater than 2 and/or greater than 2.5.

The first line elements 14 may extend in a first direction and the second line elements 16 may extend in a second direction different from the first direction.

In one example, the average distance $D_1$ is greater than 0.25 mm and/or greater than 0.5 mm and/or greater than 0.75 mm and/or greater than 1 mm and/or greater than 1.5 mm and/or greater than 2 mm and/or less than 30 mm and/or less than 20 mm and/or less than 10 mm and/or less than 5 mm.

In another example, the average distance $D_2$ is greater than 5 mm and/or greater than 10 mm and/or greater than 15 mm and/or greater than 20 mm and/or less than 100 mm and/or less than 75 mm and/or less than 50 mm and/or less than 40 mm.

In one example, the surface 12 of the fibrous structure 10 may comprise a plurality of first line elements 14 and/or a plurality of second line elements 16.

The first line elements 14 may be parallel or substantially parallel to one another. Likewise, the second line elements 16 may be parallel or substantially parallel to one another.

In one example, the surface 12 of the fibrous structure 10 comprises both a plurality of first line elements 14, for example extending in a first direction, and a plurality of second line elements 16, for example extending in a second direction different from the first direction. In one example, the ratio of the maximum average distance between adjacent second line elements and the maximum average distance between adjacent first line elements is greater than 1 and/or greater than 1.2 and/or greater than 1.5 and/or greater than 2 and/or greater than 2.5.

In another example, at least one of the first line elements 14 is connected to at least one of the second line elements 16. One or more of the first line elements 14 may be in the same plane ("coplanar") as one or more of the second line elements 16. In one example, all of the first line elements 14 present on the surface 12 of the fibrous structure 10 are in the same plane ("coplanar") as all of the second line elements 16.

When connected, the second line element 16 may be connected to at least one of the first line elements 14 at an angle $\alpha$ of from about 5° to about 90° and/or from about 10° to about 85° and/or from about 10° to about 70° and/or from about 10° to about 40°.

In yet another example, each first line element 14 is connected to at least one second line element 16.

In one example, at least one of the first line elements 14 comprises a curvilinear line element.

In another example, at least one of the second line elements 16 comprises a curvilinear line element.

In still another example, the fibrous structure 10 of the present invention may comprise a surface 12 that further comprises a third line element 18. The third line element 18 may extend in a third direction different from the first and/or second directions. The surface 12 may comprise two or more third line elements 18. The average distance $D_3$ between two immediately adjacent third line elements 18 may be the same or different as the average distance $D_2$ between immediately second line elements 16.

One or more third line elements 18 may intersect at least one second line element 16. The intersection of a third line element 18 and a second line element 16 may occur at an angle β of from about 10° to about 90° and/or from about 45° to about 90°. In another example, the second line element 16 intersects the third line element 18 at an angle of from about 10° to about 45°.

One or more third line elements 18 may connect to at least one first line elements 14. One or more of the first line elements 14 may be in the same plane ("coplanar") as one or more of the third line elements 18. In one example, all of the first line elements 14 present on the surface 12 of the fibrous structure 10 are in the same plane ("coplanar") as all of the third line elements 18.

When connected, the third line element 18 may be connected to at least one of the first line elements 14 at an angle γ of from about 5° to about 90° and/or from about 10° to about 85° and/or from about 10° to about 70° and/or from about 10° to about 40°.

In yet another example, each first line element 14 is connected to at least one third line element 18.

Figure 11A:
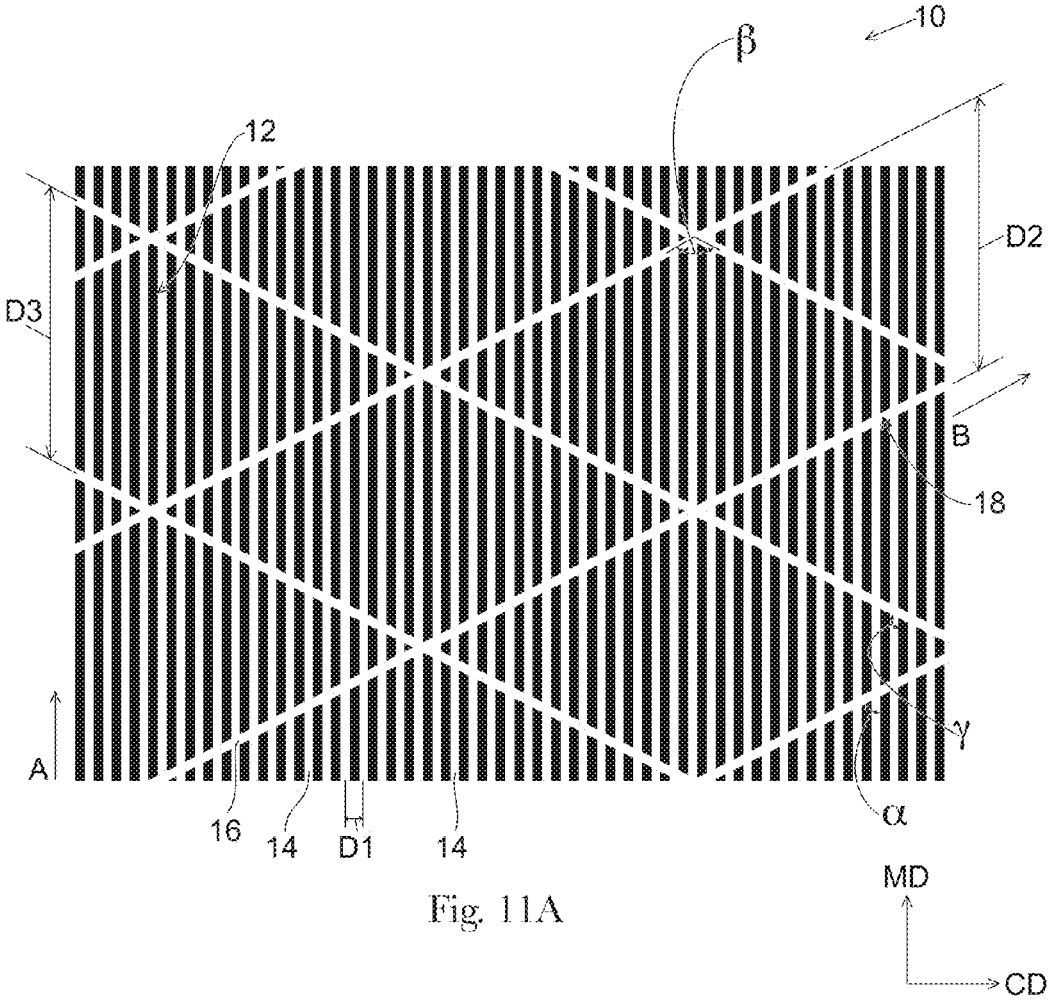
FIG. 11A is a schematic representation of another example of fibrous structure according to the present invention.
Figure 11B:
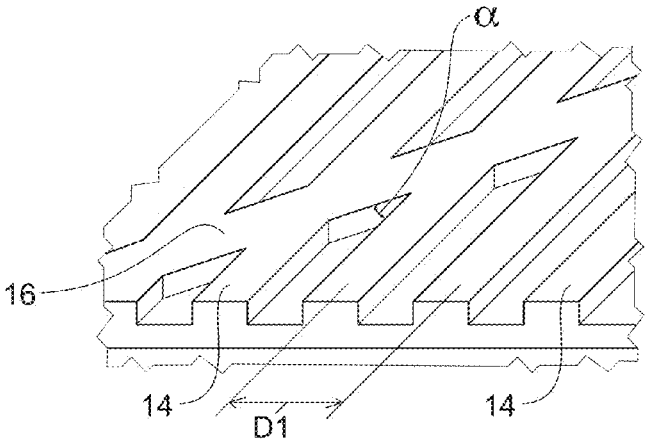
FIG. 11B is a exploded view of a portion of FIG. 11A.

FIGS. 11A and 11B show another example of a fibrous structure 10 according to the present invention. The fibrous structure 10 comprises a surface 12 and two or more first line elements 14 extending in a first direction A and two or more second line elements 16 extending in a second direction B. The fibrous structure 10 further comprises at least one third line element 18. As is evident from FIG. 11A as compared to the fibrous structure 10 of FIG. 10A, the third line element 18 of FIG. 11A intersects one or more second line elements 16 at an angle that is greater than the angle that the third line element 18 intersects one or more second line elements 16 in the fibrous structure 10 shown in FIG. 10A. The first line elements 14 comprise straight and/or substantially straight line elements. The second line elements 16 comprise straight and/or substantially straight line elements. The third line elements 18 comprise straight and/or substantially straight line elements.

Figure 12A:
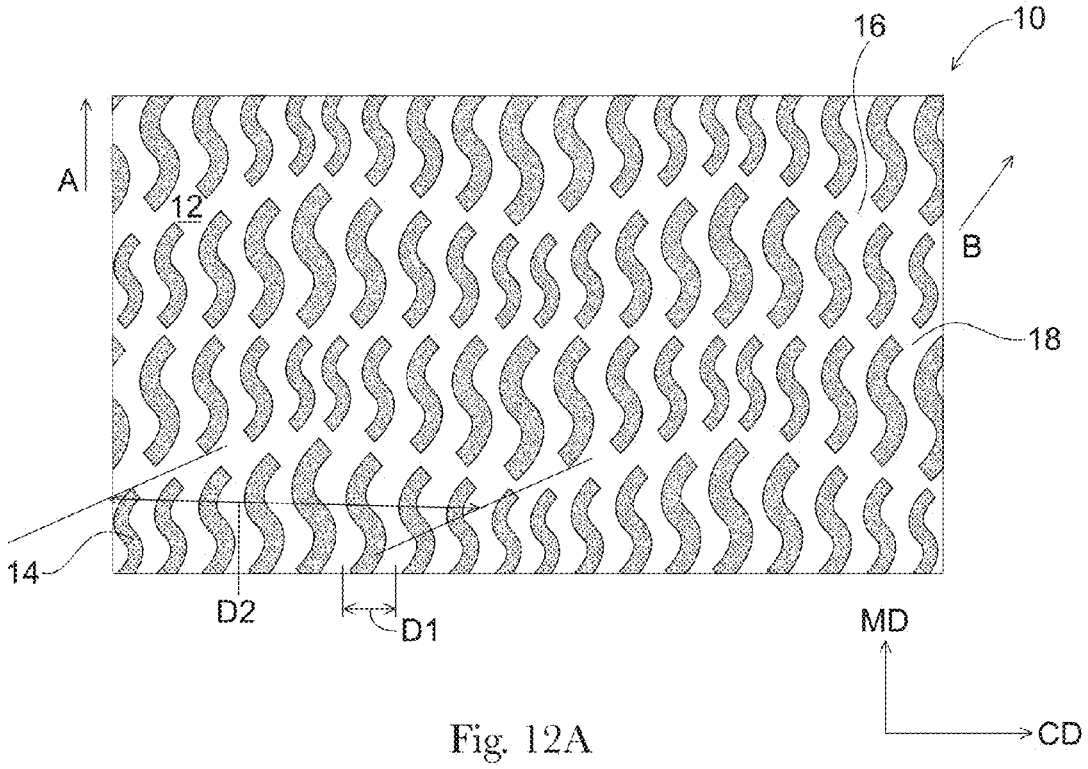
FIG. 12A is a schematic representation of another example of fibrous structure according to the present invention.
Figure 12B:
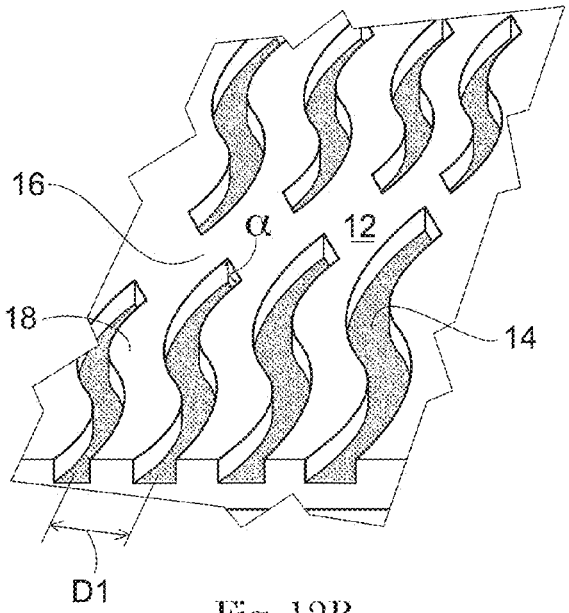
FIG. 12B is a exploded view of a portion of FIG. 12A.

As shown in FIGS. 12A and 12B, the fibrous structure 10 comprises a surface 12 comprising first line elements 14 and second line elements 16 and at least one third line element 18. The first line elements 14 comprise curvilinear elements. The second line elements 16 comprise straight and/or substantially straight line elements. The third line element 18 comprises a straight and/or substantially straight line element.

Figure 13A:
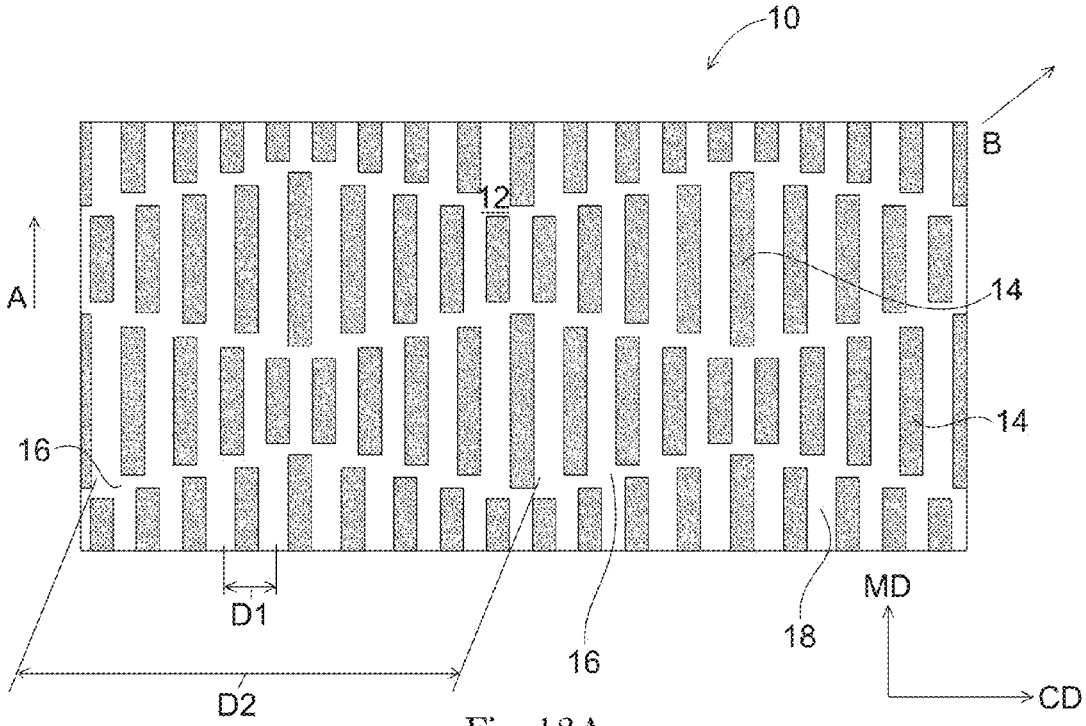
FIG. 13A is a schematic representation of another example of fibrous structure according to the present invention.
Figure 13B:
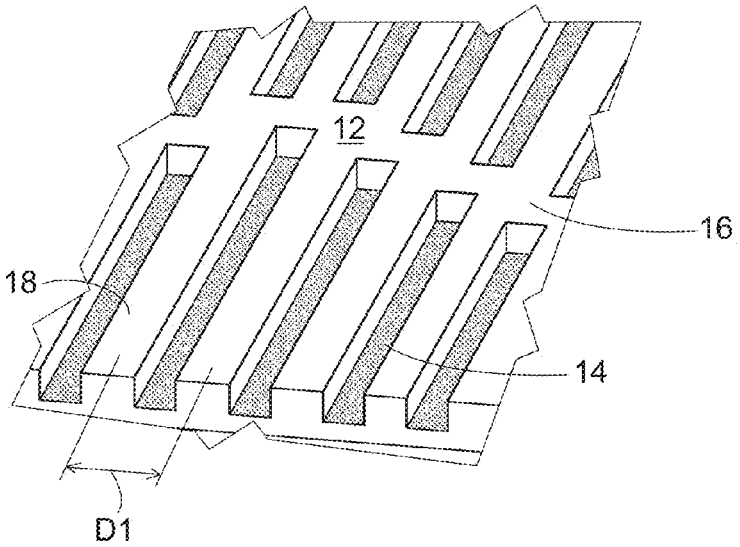
FIG. 13B is a exploded view of a portion of FIG. 13A.

FIGS. 13A and 13B illustrate a fibrous structure 10 comprising a surface 12 comprising first line elements 14 and second line elements 16 and at least one third line element 18. The first line elements 14 comprise straight and/or substantially straight line elements. The second line elements 16 comprise curvilinear line elements. The third line element 18 comprises a curvilinear line element.

Figure 14A:
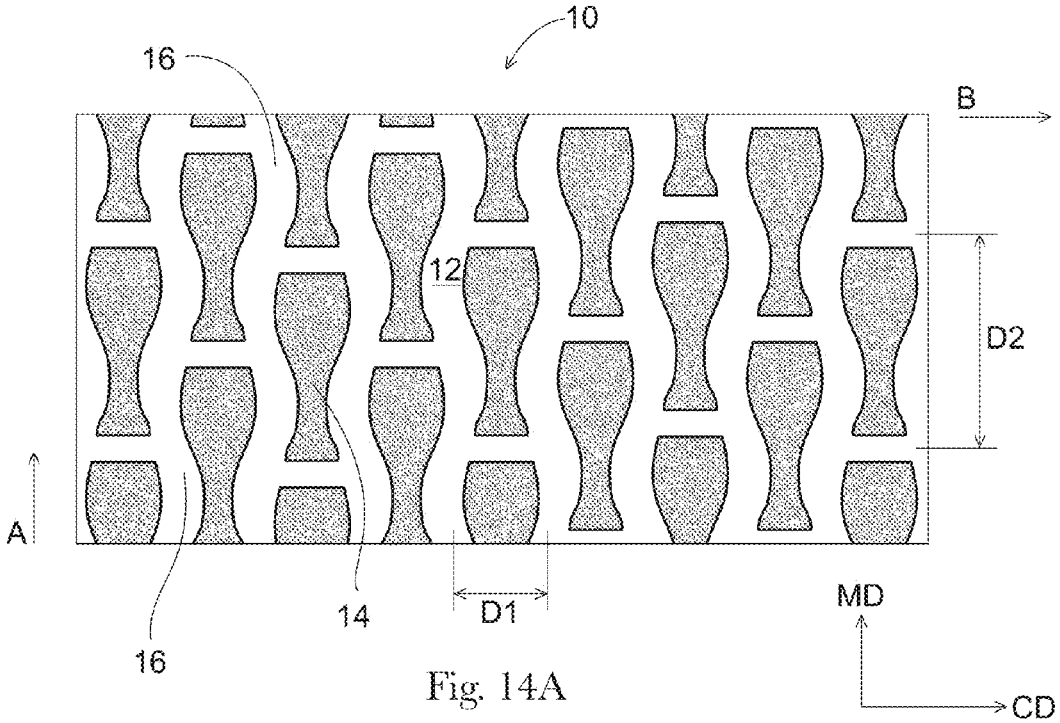
FIG. 14A is a schematic representation of another example of fibrous structure according to the present invention.
Figure 14B:
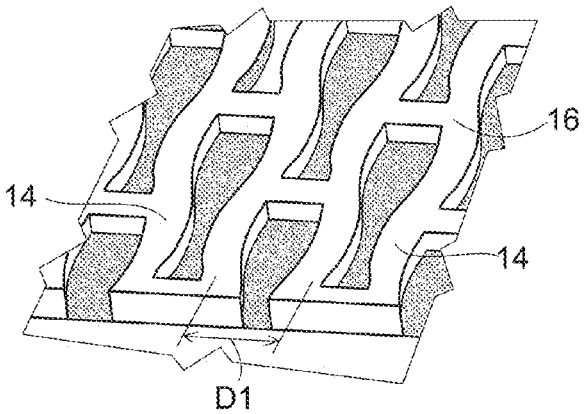
FIG. 14B is a exploded view of a portion of FIG. 14A.

FIGS. 14A and 14B show a fibrous structure 10 comprising a surface 12 comprising first line elements 14 and second line elements 16. The first line elements 14 comprise curvilinear line elements. The second line elements 16 comprise curvilinear line elements.

The fibrous structure of the present invention may comprise fibers and/or filaments. In one example, the fibrous structure comprises pulp fibers, for example, the fibrous structure may comprise greater than 50% and/or greater than 75% and/or greater than 90% and/or to about 100% by weight on a dry fiber basis of pulp fibers. In another example, the fibrous structure may comprise softwood pulp fibers, for example NSK pulp fibers.

The fibrous structure of the present invention may comprise strength agents, for example temporary wet strength agents, such as glyoxylated polyacrylamides, which are commercially available from Ashland Inc. under the tradename Hercobond, and/or permanent wet strength agents, an example of which is commercially available as Kymene® from Ashland Inc., and/or dry strength agents, such as carboxymethylcellulose ("CMC") and/or starch.

The fibrous structure of the present invention may exhibit improved properties compared to known fibrous structures. For example, the fibrous structure of the present invention may exhibit a Total Dry Tensile/(lb of Softwood Fibers)/(lb of Temporary Wet Strength Agent)/(lb of Dry Strength Agent, if any)/(NHPD/ton)/% Crepe of greater than 0.33 and/or greater than 0.4 and/or greater than 0.5 and/or greater than 0.7.

In another example, the fibrous structure of the present invention may exhibit a Total Wet Tensile/(lb of Softwood Fibers)/(lb of Temporary Wet Strength Agent)/(lb of Dry Strength Agent, if any)/(Net Horsepower Per Day (NHPD)/ton)/% Crepe of greater than 0.063 and/or greater than 0.07 and/or greater than 0.09 and/or greater than 0.12 and/or greater than 0.15.

In still another example, the fibrous structure of the present invention may exhibit a Total Dry Tensile/(lb of Softwood Fibers)/(lb of Permanent Wet Strength Agent)/(lb of Dry Strength Agent, if any)/(NHPD/ton)/% Crepe of greater than 0.009 and/or greater than 0.01 and/or greater than 0.015 and/or greater than 0.02 and/or greater than 0.05.

In even another example, the fibrous structure of the present invention may exhibit a Wet Burst/(lb of Softwood Fibers)/(lb of Permanent Wet Strength Agent)/(lb of Dry Strength Agent, if any)/(NHPD/ton)/% Crepe of greater than 0.0045 and/or greater than 0.006 and/or greater than 0.008 and/or greater than 0.01 and/or greater than 0.015.

Method for Making Fibrous Structure

Any suitable method known in the art for producing fibrous structures may be utilized so long as the fibrous structure of the present invention is produced therefrom.

In one example, the method comprises the steps of:

a. forming an embryonic fibrous structure (i.e., base web);

b. molding the embryonic fibrous structure using a molding member (i.e., papermaking belt) such that a fibrous structure according to the present invention is formed; and c. drying the fibrous structure.

The embryonic fibrous structure can be made from various fibers and/or filaments and can be constructed in various ways. For instance, the embryonic fibrous structure can contain pulp fibers and/or staple fibers. Further, the embryonic fibrous structure can be formed and dried in a wet-laid process using a conventional process, conventional wet-press, through-air drying process, fabric-creping process, belt-creping process or the like.

In one example, the embryonic fibrous structure is formed by a wet-laid forming section and transferred to a patterned drying belt (molding member) with the aid of vacuum air. The embryonic fibrous structure takes on a mirrored-molding of the patterned belt to provide a fibrous structure according to the present invention. The transfer and molding of the embryonic fibrous structure may also be by vacuum air, compressed air, pressing, embossing, belt-nipped rush-drag or the like.

Figure 15:
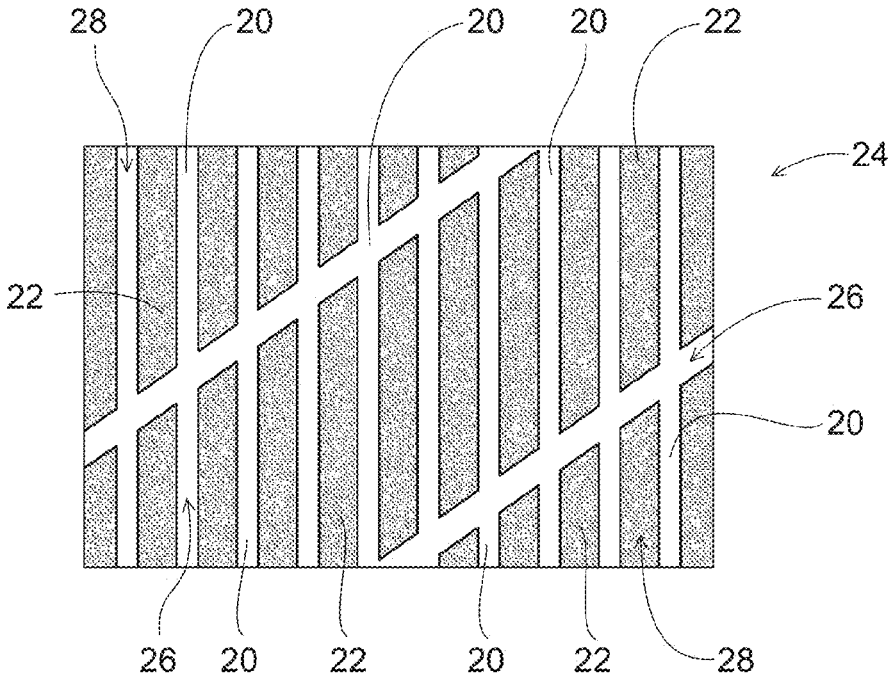
FIG. 15 is a schematic representation of an example of a patterned drying belt in accordance with the present invention.
Figure 16:
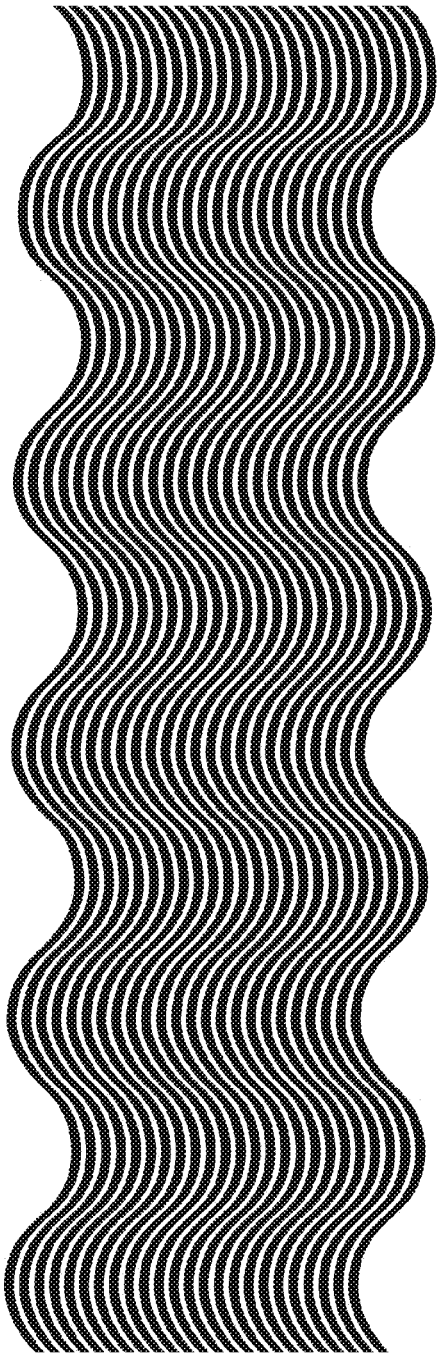
FIG. 16 is a schematic representation of an example of a pattern that can be imparted to a drying belt in accordance with the present invention.

In one example, the embryonic fibrous structure is molded into a continuous knuckle 20 and discrete cell 22 patterned drying belt (molding member and/or papermaking belt) 24 as shown in FIG. 15. The continuous knuckle 20 is formed from depositing a polymer 26 onto a support member 28, such as a fabric, for example a through-air-drying fabric. The discrete cell 22 is open to the support member, which is foraminous support member that permits air, for example heated air to pass through the embryonic fibrous structure in the discrete cell regions when the embryonic fibrous structure is in contact with the patterned drying belt.

The continuous knuckle 20 and discrete cell 22 patterned drying belt 24 design imparts three regions into the fibrous structure, a first region of high density and first elevation, a second region of low density and second elevation and a third region of a third density and third elevation positioned between the first and second regions. This type of patterned drying belt design yields a fibrous substrate having low density region "domes" having some predetermined geometric shape molded by the discrete cell and each discrete, low density dome is concentrically surrounded by a transition region which is then surrounded by a high density region.

The molded fibrous structure is partially dried to a consistency of about 40% to about 70% with a through air dried process where it is then transferred to the Yankee dryer surface by a pressure roll. The fibrous substrate, supported by the patterned drying belt, travels into the nip formed between the Yankee dyer surface and pressure roll where the first region of high density is pressed and adhered onto the Yankee dryer surface having a coating of creping adhesive. The fibrous structure is dried on the Yankee surface to a moisture level of about 1% to about 5% moisture where it is shear—separated from the Yankee surface with a creping process. The creping blade bevel can be from 15% to about 45% with the final impact angle from about 70 degrees to about 105%.

Of particular interest are the fibrous structures made in accordance to the present invention for which the individualized creping responses of the three regions provide combination of property improvements for strength and flexibility, strength and tensile energy absorption and The fibrous structure resulting from the continuous knuckle, discrete cell design may be subjected to machine-directional compressing, shearing and buckling forces as it impacts the beveled surface of the creping blade. Surprisingly, it has been discovered that when the first region is adhered to the Yankee surface that the high density, first region undergoes a machine-directional compression. The machine-directional compression at the creping blade results in a cross-directional expansion of the first regions. The cross-directional expansion of the first regions causes the juxtaposed low density second regions to buckle and fold in the machine direction. The expansion and buckling of the first and second regions creates stress in the juxtaposed third region of transition. The resulting stress in the juxtaposed third region causes the fiber ends on the surface of the third region to detach or de-bond. The de-bonding of the fiber ends increases the free-fiber ends count and lowers the tangent modulus of the third region. The combination of the juxtaposed second and third region creates a "hinge-effect", resulting in improved cross-directional flexibility of the fibrous structure. Further improvements and control to cross-directional flexibility may be had by increasing or decreasing the frequency of "hinge" regions per inch. As the frequency count of the three regions is increased, the fibrous structure becomes more flexible and its free fiber ends increase. The presence of the continuous knuckle of the first region helps to mitigate and/or avoid the strength loss caused by the increased flexibility Alternatively, the introduction of stress to the third and/or second regions may also be accomplished by means of micro-straining, micro-embossing, ring-rolling, micro-SELFing, patterned web surface brushing and the like.

The fibrous structure may be subjected to any suitable post-processing operation such as calendering, embossing, micro-SELFing, ring rolling, printing, lotioning, folding, and the like. In one example, the fibrous structure is subject to a post-processing calendering operation.

Non-limiting Examples

Example 1

An example of a fibrous structure in accordance with the present invention may be prepared using a fibrous structure making machine having a layered headbox having a top middle and bottom chamber.

A hardwood stock chest is prepared with eucalyptus (Fibria Brazilian bleached hardwood kraft pulp) fiber having a consistency of about 3.0% by weight. A softwood stock chest is prepared with NSK (northern softwood Kraft) fibers having a consistency of about 3.0% by weight. The NSK fibers are refined to a Canadian Standard Freenesss (CSF) of about 540 to 545 ml.

A 2% solution of a permanent wet strength agent, for example Kymene® 1142, is added to the NSK stock pipe prior to refining at about 17.5 lbs. per ton of dry fiber. Kymene® 1142 is supplied by Hercules Corp of Wilmington, Del. A 1% solution of a dry strength agent, for example carboxy methyl cellulose (CMC), is added to the NSK slurry at a rate of about 2 lbs. per ton of dry fiber to enhance the dry strength of the fibrous structure. CMC is supplied by CP Kelco. The resulting aqueous slurry of NSK fibers passes through a centrifugal stock pump to aid in distributing the CMC.

The NSK slurry is diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are directed to a multi-channeled headbox suitably equipped with layering leaves to maintain the streams as stratified layers until discharged onto a traveling Fourdrinier wire. A three layered headbox is used. The eucalyptus slurry, containing 75% of the dry weight of the tissue ply is directed to the middle and bottom chambers leading to the layer in contact with the wire, while the NSK slurry comprising of 25% of the dry weight of the ultimate tissue ply is directed to the chamber leading to the outside layer. The NSK and eucalyptus slurries are combined at the discharge of the headline into a composite slurry.

The composite slurry is discharged onto the traveling Fourdrinier wire and is dewatered assisted by a deflector and vacuum boxes. The Fourdrinier wire is of a 5-shed, satin weave configuration having 105 machine-direction and 107 cross-machine-direction monofilaments per inch. The speed of the Fourdrinier wire is about 800 fpm (feet per minute).

The embryonic wet web is transferred from the Fourdrinier wire, at a fiber consistency of about 15% at the point of transfer, to a patterned drying fabric. The speed of the patterned drying fabric is the same as the speed of the Fourdrinier wire. The drying fabric is designed to yield a pattern of substantially machine direction oriented linear channels having a continuous network of high density areas resulting in a contact area (knuckle area) of about 49%. This drying fabric is formed by casting an impervious resin surface onto a fiber mesh supporting fabric. The supporting fabric is a 127×45 filament mesh. The thickness of the resin cast is about 7 mils above the supporting fabric.

Further de-watering is accomplished by vacuum assisted drainage until the web has a fiber consistency of about 25%. While remaining in contact with the patterned drying fabric, the web is pre-dried by air blow-through pre-dryers to a fiber consistency of about 65% by weight.

After the pre-dryers, the semi-dry web is transferred to the Yankee dryer and adhered to the surface of the Yankee dryer with a sprayed a creping adhesive coating. The coating is a blend consisting of Vinylon Works' Vinylon 99-60 and Georgia Pacific's Unicrepe 457T20 Creping Aid. The fiber consistency is increased to about 97% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. and a speed of about 800 fpm.

The dry web is passed through a rubber-on-steel calender gap (rubber on yankee side of substrate). The dry web was calendered to a thickness of about 27 mils (4 plys combined together). The fibrous structure is wound in a roll using a surface driven reel drum having a surface speed of about 690 feet per minute.

Two plies are combined with the Yankee side facing out. During the converting process, a surface softening agent is applied with a slot extrusion die to the outside surface of both plies. The surface softening consists of a 19% by weight concentration of Wacker Silicone MR1003. At a converting speed of 400 feet per minute (fpm) approximately 2 grams/minute of softening agent is applied to each web to obtain a final add on of approximately 1444 parts per million. The plies are then bonded together with mechanical plybonding wheels, slit, and then folded into finished 2-ply facial tissue product. Each ply and the combined plies are tested in accordance with the test methods described supra.

Example 2

An example of a fibrous structure in accordance with the present invention may be prepared using a fibrous structure making machine having a layered headbox having a top middle and bottom chamber.

A hardwood stock chest is prepared with eucalyptus (Fibria Brazilian bleached hardwood kraft pulp) fiber having a consistency of about 3.0% by weight. A softwood stock chest is prepared with NSK (northern softwood Kraft) fibers having a consistency of about 3.0% by weight. The NSK fibers are refined to a Canadian Standard Freenesss (CSF) of about 540 to 545 ml.

A 2% solution of a permanent wet strength agent, for example Kymene® 1142, is added to the NSK stock pipe prior to refining at about 17.5 lbs. per ton of dry fiber. Kymene® 1142 is supplied by Hercules Corp of Wilmington, Del. A 1% solution of a dry strength agent, for example carboxy methyl cellulose (CMC), is added to the NSK slurry at a rate of about 2 lbs. per ton of dry fiber to enhance the dry strength of the fibrous structure. CMC is supplied by CP Kelco. The resulting aqueous slurry of NSK fibers passes through a centrifugal stock pump to aid in distributing the CMC.

The NSK slurry is diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are directed to a multi-channeled headbox suitably equipped with layering leaves to maintain the streams as stratified layers until discharged onto a traveling Fourdrinier wire. A three layered headbox is used. The eucalyptus slurry, containing 75% of the dry weight of the tissue ply is directed to the middle and bottom chambers leading to the layer in contact with the wire, while the NSK slurry comprising of 25% of the dry weight of the ultimate tissue ply is directed to the chamber leading to the outside layer. The NSK and eucalyptus slurries are combined at the discharge of the headline into a composite slurry.

The composite slurry is discharged onto the traveling Fourdrinier wire and is dewatered assisted by a deflector and vacuum boxes. The Fourdrinier wire is of a 5-shed, satin weave configuration having 105 machine-direction and 107 cross-machine-direction monofilaments per inch. The speed of the Fourdrinier wire is about 800 fpm (feet per minute).

The embryonic wet web is transferred from the Fourdrinier wire, at a fiber consistency of about 15% at the point of transfer, to a patterned drying fabric. The speed of the patterned drying fabric is the same as the speed of the Fourdrinier wire. The drying fabric is designed to yield a pattern of substantially machine direction oriented linear channels having a continuous network of high density areas resulting in a contact area (knuckle area) of about 49%. This drying fabric is formed by casting an impervious resin surface onto a fiber mesh supporting fabric. The supporting fabric is a 127×45 filament mesh. The thickness of the resin cast is about 7 mils above the supporting fabric.

Further de-watering is accomplished by vacuum assisted drainage until the web has a fiber consistency of about 25%. While remaining in contact with the patterned drying fabric, the web is pre-dried by air blow-through pre-dryers to a fiber consistency of about 65% by weight.

After the pre-dryers, the semi-dry web is transferred to the Yankee dryer and adhered to the surface of the Yankee dryer with a sprayed a creping adhesive coating. The coating is a blend consisting of Vinylon Works' Vinylon 99-60 and Georgia Pacific's Unicrepe 457T20 Creping Aid. The fiber consistency is increased to about 97% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. and a speed of about 800 fpm.

The dry web is passed through a rubber-on-steel calender nip (rubber on yankee side of substrate) with an approximate loading force of 260 pounds/in (pli). The dry web was calendered to a thickness of about 21 mils (4 plys combined together). The fibrous structure is wound in a roll using a surface driven reel drum having a surface speed of about 690 feet per minute.

Two plies are combined with the Yankee side facing out. During the converting process, a surface softening agent is applied with a slot extrusion die to the outside surface of both plies. The surface softening consists of a 19% by weight concentration of Wacker Silicone MR 1003. At a converting speed of 400 feet per minute (fpm) approximately 2 grams/minute of softening agent is applied to each web to obtain a final add on of approximately 1559 parts per million. The plies are then bonded together with mechanical plybonding wheels, slit, and then folded into finished 2-ply facial tissue product. Each ply and the combined plies are tested in accordance with the test methods described supra.

Example 3

An example of a fibrous structure in accordance with the present invention may be prepared using a fibrous structure making machine having a layered headbox having a top middle and bottom chamber.

A hardwood stock chest is prepared with eucalyptus (Fibria Brazilian bleached hardwood kraft pulp) fiber having a consistency of about 3.0% by weight. A softwood stock chest is prepared with NSK (northern softwood Kraft) fibers having a consistency of about 3.0% by weight. The NSK fibers are refined to a Canadian Standard Freenesss (CSF) of about 540 to 545 ml.

A 2% solution of a permanent wet strength agent, for example Kymene® 1142, is added to the NSK stock pipe prior to refining at about 17.5 lbs. per ton of dry fiber. Kymene® 1142 is supplied by Hercules Corp of Wilmington, Del. A 1% solution of a dry strength agent, for example carboxy methyl cellulose (CMC), is added to the NSK slurry at a rate of about 2 lbs. per ton of dry fiber to enhance the dry strength of the fibrous structure. CMC is supplied by CP Kelco. The resulting aqueous slurry of NSK fibers passes through a centrifugal stock pump to aid in distributing the CMC.

The NSK slurry is diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are directed to a multi-channeled headbox suitably equipped with layering leaves to maintain the streams as stratified layers until discharged onto a traveling Fourdrinier wire. A three layered headbox is used. The eucalyptus slurry, containing 75% of the dry weight of the tissue ply is directed to the middle and bottom chambers leading to the layer in contact with the wire, while the NSK slurry comprising of 25% of the dry weight of the ultimate tissue ply is directed to the chamber leading to the outside layer. The NSK and eucalyptus slurries are combined at the discharge of the headline into a composite slurry.

The composite slurry is discharged onto the traveling Fourdrinier wire and is dewatered assisted by a deflector and vacuum boxes. The Fourdrinier wire is of a 5-shed, satin weave configuration having 105 machine-direction and 107 cross-machine-direction monofilaments per inch. The speed of the Fourdrinier wire is about 800 fpm (feet per minute).

The embryonic wet web is transferred from the Fourdrinier wire, at a fiber consistency of about 15% at the point of transfer, to a patterned drying fabric. The speed of the patterned drying fabric is the same as the speed of the Fourdrinier wire. The drying fabric is designed to yield a pattern of substantially machine direction oriented linear channels having a continuous network of high density areas resulting in a contact area (knuckle area) of about 49%. This drying fabric is formed by casting an impervious resin surface onto a fiber mesh supporting fabric. The supporting fabric is a 127×45 filament mesh. The thickness of the resin cast is about 7 mils above the supporting fabric.

Further de-watering is accomplished by vacuum assisted drainage until the web has a fiber consistency of about 25%. While remaining in contact with the patterned drying fabric, the web is pre-dried by air blow-through pre-dryers to a fiber consistency of about 65% by weight.

After the pre-dryers, the semi-dry web is transferred to the Yankee dryer and adhered to the surface of the Yankee dryer with a sprayed a creping adhesive coating. The coating is a blend consisting of Vinylon Works' Vinylon 99-60 and Georgia Pacific's Unicrepe 457T20 Creping Aid. The fiber consistency is increased to about 97% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. and a speed of about 800 fpm.

The dry web is passed through a rubber-on-steel calender nip (rubber on yankee side of substrate) with an approximate loading force of 260 pounds/in (pli). The dry web was calendered to a thickness of about 21 mils (4 plys combined together). The fibrous structure is wound in a roll using a surface driven reel drum having a surface speed of about 690 feet per minute.

Two plies are combined with the wire side facing out. During the converting process, a surface softening agent is applied with a slot extrusion die to the outside surface of both plies. The surface softening consists of a 19% by weight concentration of Wacker Silicone MR1003. At a converting speed of 400 feet per minute (fpm) approximately 3 grams/minute of softening agent is applied to each web to obtain a final add on of approximately 1738 parts per million. The plies are then bonded together with mechanical plybonding wheels, slit, and then folded into finished 2-ply facial tissue product. Each ply and the combined plies are tested in accordance with the test methods described supra.

Example 4

An example of a fibrous structure in accordance with the present invention may be prepared using a fibrous structure making machine having a layered headbox having a top middle and bottom chamber.

A hardwood stock chest is prepared with eucalyptus (Fibria Brazilian bleached hardwood kraft pulp) fiber having a consistency of about 3.0% by weight. A softwood stock chest is prepared with NSK (northern softwood Kraft) fibers having a consistency of about 3.0% by weight. The NSK fibers are refined to a Canadian Standard Freenesss (CSF) of about 540 to 545 ml.

A 2% solution of a permanent wet strength agent, for example Kymene® 1142, is added to the NSK stock pipe prior to refining at about 17.5 lbs. per ton of dry fiber. Kymene® 1142 is supplied by Hercules Corp of Wilmington, Del. A 1% solution of a dry strength agent, for example carboxy methyl cellulose (CMC), is added to the NSK slurry at a rate of about 2 lbs. per ton of dry fiber to enhance the dry strength of the fibrous structure. CMC is supplied by CP Kelco. The resulting aqueous slurry of NSK fibers passes through a centrifugal stock pump to aid in distributing the CMC.

The NSK slurry is diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are directed to a multi-channeled headbox suitably equipped with layering leaves to maintain the streams as stratified layers until discharged onto a traveling Fourdrinier wire. A three layered headbox is used. The eucalyptus slurry, containing 75% of the dry weight of the tissue ply is directed to the middle and bottom chambers leading to the layer in contact with the wire, while the NSK slurry comprising of 25% of the dry weight of the ultimate tissue ply is directed to the chamber leading to the outside layer. The NSK and eucalyptus slurries are combined at the discharge of the headline into a composite slurry.

The composite slurry is discharged onto the traveling Fourdrinier wire and is dewatered assisted by a deflector and vacuum boxes. The Fourdrinier wire is of a 5-shed, satin weave configuration having 105 machine-direction and 107 cross-machine-direction monofilaments per inch. The speed of the Fourdrinier wire is about 800 fpm (feet per minute).

The embryonic wet web is transferred from the Fourdrinier wire, at a fiber consistency of about 15% at the point of transfer, to a patterned drying fabric. The speed of the patterned drying fabric is the same as the speed of the Fourdrinier wire. The drying fabric is designed to yield a pattern of substantially machine direction oriented linear channels having a continuous network of high density areas resulting in a contact area (knuckle area) of about 49%. This drying fabric is formed by casting an impervious resin surface onto a fiber mesh supporting fabric. The supporting fabric is a 127×45 filament mesh. The thickness of the resin cast is about 7 mils above the supporting fabric.

Further de-watering is accomplished by vacuum assisted drainage until the web has a fiber consistency of about 25%. While remaining in contact with the patterned drying fabric, the web is pre-dried by air blow-through pre-dryers to a fiber consistency of about 65% by weight.

After the pre-dryers, the semi-dry web is transferred to the Yankee dryer and adhered to the surface of the Yankee dryer with a sprayed a creping adhesive coating. The coating is a blend consisting of Vinylon Works' Vinylon 99-60 and Georgia Pacific's Unicrepe 457T20 Creping Aid. The fiber consistency is increased to about 97% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. and a speed of about 800 fpm.

The dry web is passed through a rubber-on-steel calender nip (rubber on yankee side of substrate) with an approximate loading force of 260 pounds/in (pli). The dry web was calendered to a thickness of about 21 mils (4 plys combined together). The fibrous structure is wound in a roll using a surface driven reel drum having a surface speed of about 690 feet per minute.

Two plies are combined with the wire side facing out. During the converting process, a surface softening agent is applied with a slot extrusion die to the outside surface of both plies. The surface softening consists of a 19% by weight concentration of Wacker Silicone MR 1003. At a converting speed of 400 feet per minute (fpm) approximately 6 grams/minute of softening agent is applied to each web to obtain a final add on of approximately 2864 parts per million. The plies are then bonded together with mechanical plybonding wheels, slit, and then folded into finished 2-ply facial tissue product. Each ply and the combined plies are tested in accordance with the test methods described supra.

Test Methods

Unless otherwise specified, all tests described herein including those described under the Definitions section and the following Test Methods are conducted on samples that have been conditioned in a conditioned room at a temperature of 73° F.±4° F. (about 23° C.±2.2° C.) and a relative humidity of 50%±10% for 2 hours prior to the test. All plastic and paper board packaging materials must be carefully removed from the paper samples prior to testing. Discard any damaged product. All tests are conducted in such conditioned room.

Flexural Rigidity Test Method

This test is performed on 1 inch×6 inch (2.54 cm×15.24 cm) strips of a fibrous structure and/or sanitary tissue product sample. A Cantilever Bending Tester such as described in ASTM Standard D 1388 (Model 5010, Instrument Marketing Services, Fairfield, NJ) is used and operated at a ramp angle of 41.5±0.5° and a sample slide speed of 0.5±0.2 in/second (1.3 ±0.5 cm/second). A minimum of n=16 tests are performed on each sample from n=8 sample strips.

No fibrous structure sample which is creased, bent, folded, perforated, or in any other way weakened should ever be tested using this test. A non-creased, non-bent, non-folded, non-perforated, and non-weakened in any other way fibrous structure sample should be used for testing under this test.

From one fibrous structure sample of about 4 inch×6 inch (10.16 cm×15.24 cm), carefully cut using a 1 inch (2.54 cm) JDC Cutter (available from Thwing-Albert Instrument Company, Philadelphia, Pa.) four (4) 1 inch (2.54 cm) wide by 6 inch (15.24 cm) long strips of the fibrous structure in the MD direction. From a second fibrous structure sample from the same sample set, carefully cut four (4) 1 inch (2.54 cm) wide by 6 inch (15.24 cm) long strips of the fibrous structure in the CD direction. It is important that the cut be exactly perpendicular to the long dimension of the strip. In cutting non-laminated two-ply fibrous structure strips, the strips should be cut individually. The strip should also be free of wrinkles or excessive mechanical manipulation which can impact flexibility. Mark the direction very lightly on one end of the strip, keeping the same surface of the sample up for all strips. Later, the strips will be turned over for testing, thus it is important that one surface of the strip be clearly identified, however, it makes no difference which surface of the sample is designated as the upper surface.

Using other portions of the fibrous structure (not the cut strips), determine the basis weight of the fibrous structure sample in lbs/3000 $ft^2$ and the caliper of the fibrous structure in mils (thousandths of an inch) using the standard procedures disclosed herein. Place the Cantilever Bending Tester level on a bench or table that is relatively free of vibration, excessive heat and most importantly air drafts. Adjust the platform of the Tester to horizontal as indicated by the leveling bubble and verify that the ramp angle is at 41.5±0.5°. Remove the sample slide bar from the top of the platform of the Tester. Place one of the strips on the horizontal platform using care to align the strip parallel with the movable sample slide. Align the strip exactly even with the vertical edge of the Tester wherein the angular ramp is attached or where the zero mark line is scribed on the Tester. Carefully place the sample slide bar back on top of the sample strip in the Tester. The sample slide bar must be carefully placed so that the strip is not wrinkled or moved from its initial position.

Move the strip and movable sample slide at a rate of approximately 0.5±0.2 in/second (1.3±0.5 cm/second) toward the end of the Tester to which the angular ramp is attached. This can be accomplished with either a manual or automatic Tester. Ensure that no slippage between the strip and movable sample slide occurs. As the sample slide bar and strip project over the edge of the Tester, the strip will begin to bend, or drape downward. Stop moving the sample slide bar the instant the leading edge of the strip falls level with the ramp edge. Read and record the overhang length from the linear scale to the nearest 0.5 mm. Record the distance the sample slide bar has moved in cm as overhang length. This test sequence is performed a total of eight (8) times for each fibrous structure in each direction (MD and CD). The first four strips are tested with the upper surface as the fibrous structure was cut facing up. The last four strips are inverted so that the upper surface as the fibrous structure was cut is facing down as the strip is placed on the horizontal platform of the Tester.

The average overhang length is determined by averaging the sixteen (16) readings obtained on a fibrous structure.

$$\text{Overhang Length } MD = \frac{\text{Sum of 8 } MD \text{ readings}}{8}$$

$$\text{Overhang Length } CD = \frac{\text{Sum of 8 } CD \text{ readings}}{8}$$

$$\text{Overhang Length Total} = \frac{\text{Sum of all 16 readings}}{16}$$

$$\text{Bend Length } MD = \frac{\text{Overhang Length } MD}{2}$$

$$\text{Bend Length } CD = \frac{\text{Overhang Length } CD}{2}$$

$$\text{Bend Length Total} = \frac{\text{Overhang Length Total}}{2}$$

$$\text{Flexural Rigidity} = 0.1629 \times W \times C^3$$

wherein W is the basis weight of the fibrous structure in lbs/3000 $ft^2$; C is the bending length (MD or CD or Total) in cm; and the constant 0.1629 is used to convert the basis weight from English to metric units. The results are expressed in mg*$cm^2$/cm.

GM Flexural Rigidity=Square root of (MD Flexural Rigidity×CD Flexural Rigidity)

Basis Weight Test Method

Basis weight of a fibrous structure and/or sanitary tissue product sample is measured by selecting twelve (12) usable units (also referred to as sheets) of the fibrous structure and making two stacks of six (6) usable units each. Perforation must be aligned on the same side when stacking the usable units. A precision cutter is used to cut each stack into exactly 8.89 cm×8.89 cm (3.5 in.×3.5 in.) squares. The two stacks of cut squares are combined to make a basis weight pad of twelve (12) squares thick. The basis weight pad is then weighed on a top loading balance with a minimum resolution of 0.01 g. The top loading balance must be protected from air drafts and other disturbances using a draft shield. Weights are recorded when the readings on the top loading balance become constant. The Basis Weight is calculated as follows:

$$\text{Basis Weight (lbs/3000 ft}^2) = \frac{\text{Weight of basis weight pad (g)} \times 3000 \text{ ft}^2}{453.6 \text{ g/lbs} \times 12 \text{ (usable units)} \times [12.25 \text{ in}^2 \text{(Area of basis weight pad)}/144 \text{ in}^2]}$$

$$\text{Basis Weight (g/m}^2) = \frac{\text{Weight of basis weight pad (g)} \times 10{,}000 \text{ cm}^2/\text{m}^2}{79.0321 \text{ cm}^2 \text{ (Area of basis weight pad)} \times 12 \text{ (usable units)}}$$

Caliper Test Method

Caliper of a fibrous structure and/or sanitary tissue product is measured by cutting five (5) samples of fibrous structure such that each cut sample is larger in size than a load foot loading surface of a VIR Electronic Thickness Tester Model II available from Thwing-Albert Instrument Company, Philadelphia, Pa. Typically, the load foot loading surface has a circular surface area of about 3.14 $in^2$. The sample is confined between a horizontal flat surface and the load foot loading surface. The load foot loading surface applies a confining pressure to the sample of 15.5 g/$cm^2$. The caliper of each sample is the resulting gap between the flat surface and the load foot loading surface. The caliper is calculated as the average caliper of the five samples. The result is reported in millimeters (mm).

Elongation, Tensile Strength, TEA and Modulus Test Methods

Obtain 4 stacks of 5 samples each of fibrous structures and/or sanitary tissue products having sufficient MD and CD dimensions for the required steps below. Identify 2 of the stacks for machine direction tensile measurements and the remaining 2 stacks for cross direction tensile measurements.

Cut two 1 inch (2.54 cm) wide strip in the machine direction from each of the MD stacks. Cut two 1 inch (2.54 cm) wide strip in the cross direction from each of the CD stacks. There are now four 1 inch (2.54 cm) wide (5 sample thick) strips for machine direction tensile testing and four 1 inch (2.54 cm) wide (5 sample thick) strips for cross direction tensile testing.

For the actual measurement of the elongation, tensile strength, TEA and modulus, use a Thwing-Albert Intelect II Standard Tensile Tester (Thwing-Albert Instrument Co. of Philadelphia, Pa.). Insert the flat face clamps into the unit and calibrate the tester according to the instructions given in the operation manual of the Thwing-Albert Intelect II. Set the instrument crosshead speed to 4.00 in/min (10.16 cm/min) and the 1st and 2nd gauge lengths to 2.00 inches (5.08 cm). The break sensitivity is set to 20.0 grams and the sample width is set to 1.00 inch (2.54 cm) and the sample thickness is set to 0.3937 inch (1 cm). The energy units are set to TEA and the tangent modulus (Modulus) trap setting is set to 38.1 g.

Take one of the sample strips (1 inch wide by 5 samples thick) and place one end of it in one clamp of the tensile tester. Place the other end of the sample strip in the other clamp. Make sure the long dimension of the sample strip is running parallel to the sides of the tensile tester. Also make sure the sample strips are not overhanging to the either side of the two clamps. In addition, the pressure of each of the clamps must be in full contact with the sample strip.

After inserting the sample strip into the two clamps, the instrument tension can be monitored. If it shows a value of 5 grams or more, the fibrous structure sample strip is too taut. Conversely, if a period of 2-3 seconds passes after starting the test before any value is recorded, the sample strip is too slack.

Start the tensile tester as described in the tensile tester instrument manual. The test is complete after the crosshead automatically returns to its initial starting position. When the test is complete, read and record the following with units of measure:

Peak Load Tensile (Tensile Strength) (g/in)

Peak Elongation (Elongation) (%)

Peak TEA (TEA) (in-g/$in^2$)

Tangent Modulus (Modulus) (at 15g/cm)

Test each of the samples in the same manner, recording the above measured values from each test.

Calculations

Geometric Mean (GM) Elongation=Square Root of [MD Elongation (%)×CD Elongation (%)]

Total Dry Tensile (TDT)=Peak Load MD Tensile (g/in)+Peak Load CD Tensile (g/in)

Tensile Ratio=Peak Load MD Tensile (g/in)/Peak Load CD Tensile (g/in)

Geometric Mean (GM) Tensile=[Square Root of (Peak Load MD Tensile (g/in)×Peak Load CD Tensile (g/in))]×3

TEA=MD TEA ($g*in/in^2$)+CD TEA ($g*in/in^2$)

Geometric Mean (GM) TEA=Square Root of [MD TEA ($g*in/in^2$)×CD TEA ($g*in/in^2$)]

Modulus=MD Modulus (g/cm*% at 15g/cm)+CD Modulus (g/cm*% at 15g/cm)

Geometric Mean (GM) Modulus =Square Root of [MD Modulus (g/cm*% at 15g/cm)×CD Modulus (g/cm*% at 15g/cm)]

Wet Burst Test Method

The wet burst of a fibrous structure or sanitary tissue product sample is measured using a Thwing-Albert Vantage Burst Tester equipped with a 2000 g load cell, a burst ball having a diameter of 0.625 inches and an interchangeable clamp having opening diameter options of 3.5 inches and 2.0 inches (if a sample is not large enough to use the 3.5 inch diameter clamp). The Thwing-Albert Vantage Burst Tester is commercially available from Thwing-Albert Instrument Company, Philadelphia, Pa.

The Burst Tester is calibrated according to the manufacturer's instructions.

Distilled water that has been conditioned according to the conditioning parameters set forth above is utilized.

Wet burst is measured by using fibrous structure and/or sanitary tissue product samples prepared as follows.

1-ply and 2-ply Paper Towels: For towels having a sheet length (MD) of approximately 11 in. (280 mm), remove two finished product sheets from the roll. Separate the finished product sheets at the perforations and stack them on top of each other. Cut the finished product sheets in half in the Machine Direction to make a sample stack of four finished product sheets thick. For finished product sheets smaller than 11 in. (280 mm), remove two strips of three finished product sheets from the roll. Stack the strips so that the perforations and edges are coincident. Remove equal portions of each of the end finished product sheets by cutting in the cross direction so that the total length of the center finished product sheets plus the remaining portions of the two end finished product sheets is approximately 11 inches (280 mm). Cut the sample stack in half in the machine direction to make a sample stack four finished product sheets thick.

Paper Napkins (Folded, Cut & Stacked): For napkins select 4 finished product sheets from the sample stack. For all napkins, either 1-ply or 2-ply and either double or triple folded, unfold the finished product sheets until it is a large rectangle with only one fold remaining in the MD direction. One-ply napkins will have 2 loose 1-ply layers, 2-ply napkins will have 2 loose 2-ply layers. Stack the finished product sheets so that the MD folded edges are aligned and the opened, CD folds are on top of each other. To prevent the wet burst test from occurring right on the opened CD fold in the center of each finished product sheet, cut one end off of the stack so that the finished product sheets are at least 10 inches (254 mm) in the MD direction and the fold is shifted off-center.

Facial Tissues C-Fold Reach-in: Remove 8 finished product sheets and stack them in pairs of two. Using scissors, cut the (C) fold off in the Machine Direction. You now have 4 stacks 9 in. (230 mm) machine direction by 4.5 in. (115 mm) cross direction, each two finished product sheets thick.

Facial Tissues-V-Fold Pop-up: Remove 8 finished product sheets and stack them in pairs of two. Using scissors, cut the stacks 4.5 in. (115 mm) from the bonded edge so you have 9 in. (230 mm) machine direction by 4.5 in. (115 mm) cross direction samples, each two finished product sheets thick.

Hankies: Remove 8 finished product sheets, unfold each completely and stack them in pairs of two.

1-Ply Toilet Tissues: If beginning a new tissue roll the first 15 finished product sheets have to be removed (to remove Tail-Release-Gluing). Roll off 16 strips of product each 3 finished product sheets in length. It is important that the center finished product sheet in each three finished product sheet strips not be stretched or wrinkled since it is the unit to be tested.

Ensure that sheet perforations are not in the area to be tested. Stack the 3 finished product sheet strips 4 high, 4 times to form your test samples.

2-Ply/3-Ply/4-Ply Toilet Tissues: If beginning a new tissue roll, the first 15 finished product sheets have to be removed (to remove Tail-Release-Gluing). Roll off 8 strips of product each, 3 finished product sheets in length, It is important the center finished product sheet in each three finished product sheet strip not be stretched or wrinkled since it is the finished product sheet to be tested. Ensure that sheet perforations are not in the area to be tested. Stack the 3 finished product sheet strips 2 high, 4 times to form your test samples.

Roll Wipes: Prep as above for 1 ply toilet tissue except remove only 3 finished product sheets 1 high, 4 times from the finished product roll. Seal remaining product in re-sealable plastic bag. It is important the center finished product sheet in each three finished product sheet strips not be stretched or wrinkled since it is the unit to be tested. Test immediately.

Stacked Wipes: remove 4 finished product sheets from the finished product container and seal remaining product in plastic bag. Test immediately.

Table 5 below provides a quick reference summary of all the sample preparation procedures described above.

TABLE 5

Reference Summary for Wet Burst Sample Preparation

| Sample Description | Number of Usable Units per Test | Number of Plies | Number of Tests (Replicates) per Sample |
|---|---|---|---|
| Finished Product | | | |
| 1-ply Towel | 1 | 1 | 4 |
| 2-ply Towel | 1 | 2 | 4 |
| 2-Ply/3-Ply Facial | 2 | 4, 6 | 4 |
| Napkins (folded, cut & stacked) | 4 (folded once) | — | 4 |
| Hankies | 2 | 8 | 4 |
| 1-Ply Toilet Tissue | 4 | 4 | 4 |
| 2-Ply/3-Ply/4-Ply Toilet Tissue | 2 | 4, 6, 8 | 4 |
| Wipes | 1 | 1 | 4 |

Operation

Set-up and calibrate the Burst Tester instrument according to the manufacturer's instructions for the instrument being used.

Remove one sample portion from the sample stack holding the sample by the narrow edges, dipping the center of the sample into a pan filled approximately 1 in. (25 mm) from the top with distilled water. Leave the sample in the water for 4 (±0.5) seconds.

Remove and drain excess water from the sample for 3 (±0.5) seconds holding the sample in a vertical position. Also, if the sample contains some hydrophobic material, it may not saturate with water in the specified time frame, and give a false high burst reading. Accordingly, if the sample contains a hydrophobic material, then the sample is tested before the hydrophobic material is added to the sample or the hydrophobic material is removed from the sample prior to testing.

Proceed with the test immediately after the drain step. Ensure the sample has no perforations in the area of the sample to be tested.

Place the wet sample on a lower ring of a sample holding device of the Burst Tester with the outer surface of the sample facing up so that the wet part of the sample completely covers the open surface of the sample holding ring. Center the wet sample flatly on the lower ring of the sample holding device. If wrinkles are present in the sample, discard the sample and repeat with a new sample. After the sample is properly in place on the lower sample holding ring, turn the switch that lowers the upper ring on the Burst Tester. The sample to be tested is now securely gripped in the sample holding unit. Start the burst test immediately at this point by pressing the start button on the Burst Tester. A plunger will begin to move toward the wet surface of the sample. At the point when the sample tears or ruptures (or when the load falls 20 g from the peak force), report the maximum force value reading. The plunger will automatically reverse and return to its original starting position. Raise the upper ring, remove and discard the tested sample. Repeat this procedure on three more samples for a total of four tests, i.e., four replicates. Report the results as an average of the four replicates, to the nearest g.

Calculations

Calculate the appropriate average wet burst results as described below. The results are reported on the basis of a single finished product sheet.

Wet Burst=sum of peak load readings/Load Divider/number of replicates tested

Report the Wet Burst results to the nearest gram

Dimensions of Linear Element/Linear Element Forming Component Test Method

The length of a linear element in a fibrous structure and/or the length of a linear element forming component in a molding member is measured by image scaling of a light microscopy image of a sample of fibrous structure.

A light microscopy image of a sample to be analyzed such as a fibrous structure or a molding member is obtained with a representative scale associated with the image. The images is saved as a *.tiff file on a computer. Once the image is saved, SmartSketch, version 05.00.35.14 software made by Intergraph Corporation of Huntsville, Alabama, is opened. Once the software is opened and running on the computer, the user clicks on "New" from the "File" drop-down panel. Next, "Normal" is selected. "Properties" is then selected from the "File" drop-down panel. Under the "Units" tab, "mm" (millimeters) is chosen as the unit of measure and "0.123" as the precision of the measurement. Next, "Dimension" is selected from the "Format" drop-down panel. Click the "Units" tab and ensure that the "Units" and "Unit Labels" read "mm" and that the "Round-Off" is set at "0.123." Next, the "rectangle" shape from the selection panel is selected and dragged into the sheet area. Highlight the top horizontal line of the rectangle and set the length to the corresponding scale indicated light microscopy image. This will set the width of the rectangle to the scale required for sizing the light microscopy image. Now that the rectangle has been sized for the light microscopy image, highlight the top horizontal line and delete the line. Highlight the left and right vertical lines and the bottom horizontal line and select "Group". This keeps each of the line segments grouped at the width dimension ("mm") selected earlier. With the group highlighted, drop the "line width" panel down and type in "0.01 mm." The scaled line segment group is now ready to use for scaling the light microscopy image can be confirmed by right-clicking on the "dimension between", then clicking on the two vertical line segments.

To insert the light microscopy image, click on the "Image" from the "insert" drop-down panel. The image type is preferably a *.tiff format. Select the light microscopy image to be inserted from the saved file, then click on the sheet to place the light microscopy image. Click on the right bottom corner of the image and drag the corner diagonally from bottom-right to top-left. This will ensure that the image's aspect ratio will not be modified. Using the "Zoom In" feature, click on the image until the light microscopy image scale and the scale group line segments can be seen. Move the scale group segment over the light microscopy image scale. Increase or decrease the light microscopy image size as needed until the light microscopy image scale and the scale group line segments are equal. Once the light microscopy image scale and the scale group line segments are visible, the object(s) depicted in the light microscopy image can be measured using "line symbols" (located in the selection panel on the right) positioned in a parallel fashion and the "Distance Between" feature. For length and width measurements, a top view of a fibrous structure and/or molding member is used as the light microscopy image. For a height measurement, a side or cross sectional view of the fibrous structure and/or molding member is used as the light microscopy image.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A wet textured fibrous structure that exhibits a GM Overhang Length of less than 3.65 cm as measured according to the Flexural Rigidity Test Method described herein.

2. The fibrous structure according to claim 1 wherein the fibrous structure comprises cellulosic pulp fibers.

3. The fibrous structure according to claim 1 wherein the fibrous structure is a throughdried fibrous structure.

4. The fibrous structure according to claim 1 wherein the fibrous structure is an uncreped fibrous structure.

5. The fibrous structure according to claim 1 wherein the fibrous structure exhibits a basis weight of greater than 15 gsm to about 120 gsm as measured according to the Basis Weight Test Method described herein.

6. The fibrous structure according to claim 1 wherein the fibrous structure is a sanitary tissue product.

7. The fibrous structure according to claim 6 wherein the sanitary tissue product is in individual sheet form.

8. The fibrous structure according to claim 6 wherein the sanitary tissue product is a multi-ply sanitary tissue product.

9. A fibrous structure that exhibits a GM Overhang Length of less than 3.65 cm as measured according to the Flexural Rigidity Test Method described herein and a Density of less than 0.073 g/cm$^3$ as measured according to the Density Test Method described herein.

10. The fibrous structure according to claim 9 wherein the fibrous structure comprises cellulosic pulp fibers.

11. The fibrous structure according to claim 9 wherein the fibrous structure is a throughdried fibrous structure.

12. The fibrous structure according to claim 9 wherein the fibrous structure is an uncreped fibrous structure.

13. The fibrous structure according to claim 9 wherein the fibrous structure exhibits a basis weight of greater than 15 gsm to about 120 gsm as measured according to the Basis Weight Test Method described herein.

14. The fibrous structure according to claim 9 wherein the fibrous structure is a sanitary tissue product.

15. The fibrous structure according to claim 14 wherein the sanitary tissue product is in individual sheet form.

16. The fibrous structure according to claim 9 wherein the sanitary tissue product is a multi-ply sanitary tissue product.

17. A non-rolled fibrous structure that exhibits a CD Overhang Length of less than 3.65 cm as measured according to the Flexural Rigidity Test Method described herein.

18. The fibrous structure according to claim 17 wherein the fibrous structure comprises cellulosic pulp fibers.

19. The fibrous structure according to claim 17 wherein the fibrous structure is a throughdried non-rolled fibrous structure.

20. The fibrous structure according to claim 17 wherein the fibrous structure is an uncreped non-rolled fibrous structure.

* * * * *